US009509057B2

(12) United States Patent
Hosono et al.

(10) Patent No.: US 9,509,057 B2
(45) Date of Patent: Nov. 29, 2016

(54) ANTENNA

(71) Applicant: FUJIKURA LTD., Tokyo (JP)

(72) Inventors: Ryohei Hosono, Sakura (JP); Ning Guan, Sakura (JP); Masahiro Iwamura, Sakura (JP); Yusuke Nakatani, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 14/908,802

(22) PCT Filed: May 16, 2014

(86) PCT No.: PCT/JP2014/063117

§ 371 (c)(1),
(2) Date: Jan. 29, 2016

(87) PCT Pub. No.: WO2015/025566

PCT Pub. Date: Feb. 26, 2015

(65) Prior Publication Data

US 2016/0190703 A1 Jun. 30, 2016

(30) Foreign Application Priority Data

Aug. 20, 2013 (JP) ..... 2013-170662

(51) Int. Cl.

| | |
|---|---|
| ***H01Q 13/00*** | (2006.01) |
| ***H01Q 13/20*** | (2006.01) |
| ***H01P 5/107*** | (2006.01) |
| ***H01Q 1/38*** | (2006.01) |

(52) U.S. Cl.
CPC ..... *H01Q 13/206* (2013.01); *H01P 5/107* (2013.01); *H01Q 1/38* (2013.01)

(58) Field of Classification Search
CPC .... H01Q 13/206; H01Q 19/30; H01Q 13/20; H01Q 13/06
USPC ..... 343/772, 767, 780, 700 MS
See application file for complete search history.

(56) References Cited

U.S. PATENT DOCUMENTS 7,450,071 B1 * 11/2008 Volman ..... H01Q 1/02 343/700 MS
2010/0134376 A1 * 6/2010 Margomenos ..... H01P 5/028 343/848

FOREIGN PATENT DOCUMENTS

JP 2008-244520 A 10/2008
JP 2008-258852 A 10/2008

(Continued)

OTHER PUBLICATIONS

International Search Report dated Jul. 22, 2014, issued in counterpart application No. PCT/JP2014/063117 (1 page).

(Continued)

*Primary Examiner* — Dameon E Levi
*Assistant Examiner* — Collin Dawkins
(74) *Attorney, Agent, or Firm* — Westerman, Hattori, Daniels & Adrian, LLP

(57) ABSTRACT

An antenna includes a dielectric substrate, an antenna conductor, a ground conductor, a waveguide tube, a shield, and short-circuit portions. The shield is provided with a cut having a reverse-taper shape whose width becomes greater from an open end of the cut to an inward end of the cut. The short-circuit portions are provided along a whole periphery of the shield except for a portion provided with the cut.

7 Claims, 24 Drawing Sheets

(56) References Cited

FOREIGN PATENT DOCUMENTS

| | | | |
|---|---|---|---|
| JP | 2009-188683 | A | 8/2009 |
| JP | 2011-223050 | A | 11/2011 |

OTHER PUBLICATIONS

Decision to Grant a Patent dated Jul. 15, 2014, issued in counterpart Japanese application No. 2013-170662 (2 pages).

* cited by examiner

ANTENNA

TECHNICAL FIELD

The present invention relates to an antenna in which a waveguide tube is attached to a comb-line microstrip antenna.

BACKGROUND ART

With advancement of wireless communications in terms of increased speed and capacity and advancement of wireless devices in terms of reduced size, there is an increasing demand for antennas operating in a millimeter wave band (30 GHz or more and 300 GHz or less). It is important to design an antenna operating in a millimeter wave band so that a conductor loss and a dielectric loss may be suppressed, because a conductor loss and a dielectric loss increase as frequency becomes higher.

A waveguide tube is preferable as a transmission path for transmitting an electromagnetic wave in a millimeter wave band. A comb-line microstrip antenna is preferable as an antenna for radiating an electromagnetic wave in a millimeter wave band.

Patent Literature 1 discloses a comb-line microstrip antenna. Patent Literature 2 discloses an antenna in which a waveguide tube is attached to a comb-line microstrip antenna.

CITATION LIST

Patent Literature

[Patent Literature 1]

Japanese Patent Application Publication, Tokukai, No. 2009-188683 (publication date: Aug. 20, 2009)

[Patent Literature 2]

Japanese Patent Application Publication, Tokukai, No. 2011-223050 (publication date: Nov. 4, 2011)

SUMMARY OF INVENTION

Technical Problem

In general, an antenna is required to have excellent reflection characteristics and excellent radiation characteristics. As for the reflection characteristics, for example, the antenna is required to have a reflection coefficient of −10 dB or less in an operation band. As for the radiation characteristics, for example, the antenna is required to have a maximum gain of 10 dBi or more and a sidelobe level of 10 dB or more.

The antennas disclosed in Patent Literatures 1 and 2 still have a room for improvement in structure for obtaining excellent reflection characteristics and radiation characteristics.

An object of the present invention is to provide an antenna having better reflection characteristics and radiation characteristics than conventional one, in which antenna a waveguide tube is attached to a comb-line microstrip antenna.

Solution to Problem

An antenna of the present invention is an antenna, including: a dielectric substrate; an antenna conductor on a front surface of the dielectric substrate, the antenna conductor being a comb-line antenna conductor including a power feed line and stubs; a ground conductor on a back surface of the dielectric substrate, the ground conductor including an opening in a region facing an input end of the power feed line; a waveguide tube joined to the back surface of the dielectric substrate, the waveguide tube having (i) a tube axis orthogonal to the back surface of the dielectric substrate and (ii) a tube wall whose edge surface surrounds the opening; a shield on the front surface of the dielectric substrate, the shield having a cut into which the input end of the power feed line is inserted; and short-circuit portions each short-circuiting the ground conductor and the shield, the short-circuit portions each penetrating the dielectric substrate, the short-circuit portions being provided along a whole periphery of the shield except for a portion provided with the cut, the cut having a reverse-taper shape whose width becomes greater from an open end of the cut to an inward end of the cut.

Advantageous Effects of Invention

The present invention makes it possible to provide an antenna having better reflection characteristics and radiation characteristics than conventional one.

BRIEF DESCRIPTION OF DRAWINGS (a) of FIG. 1 is a plan view of an antenna in accordance with an embodiment. (b) of FIG. 1 is a side view of the antenna. (c) of FIG. 1 is a bottom view of the antenna. (d) of FIG. 1 is an elevation view of the antenna.

Figure 7:
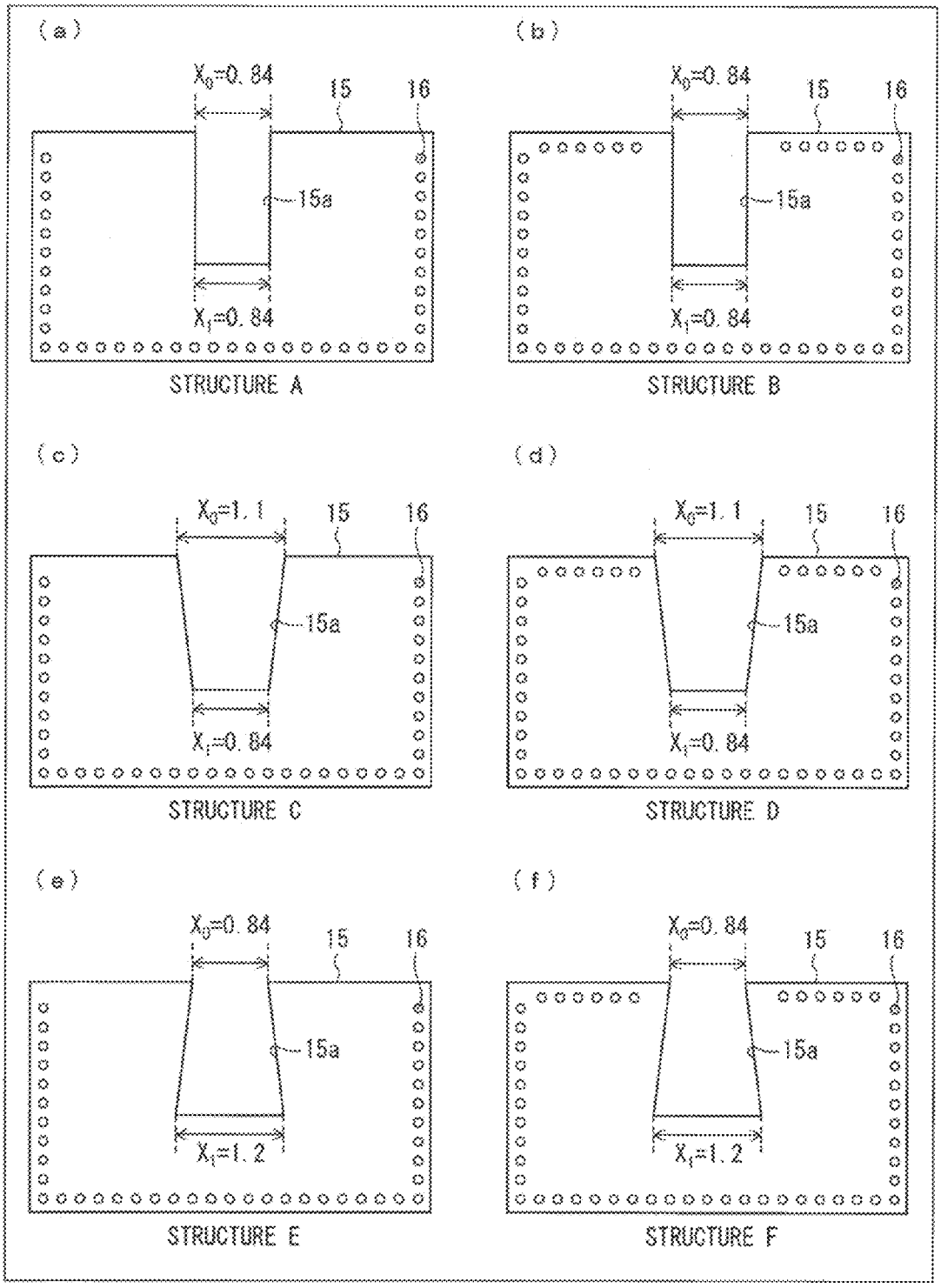

(a) to (e) of FIG. 7 are plan views of antennas in Comparative Examples. (f) of FIG. 7 is a plan view of the antenna in the Example. The antennas in the Comparative Examples are each obtained by deforming a cut in a shield of the antenna in the Example or omitting short-circuit portions of the antenna in the Example.

Figure 8:
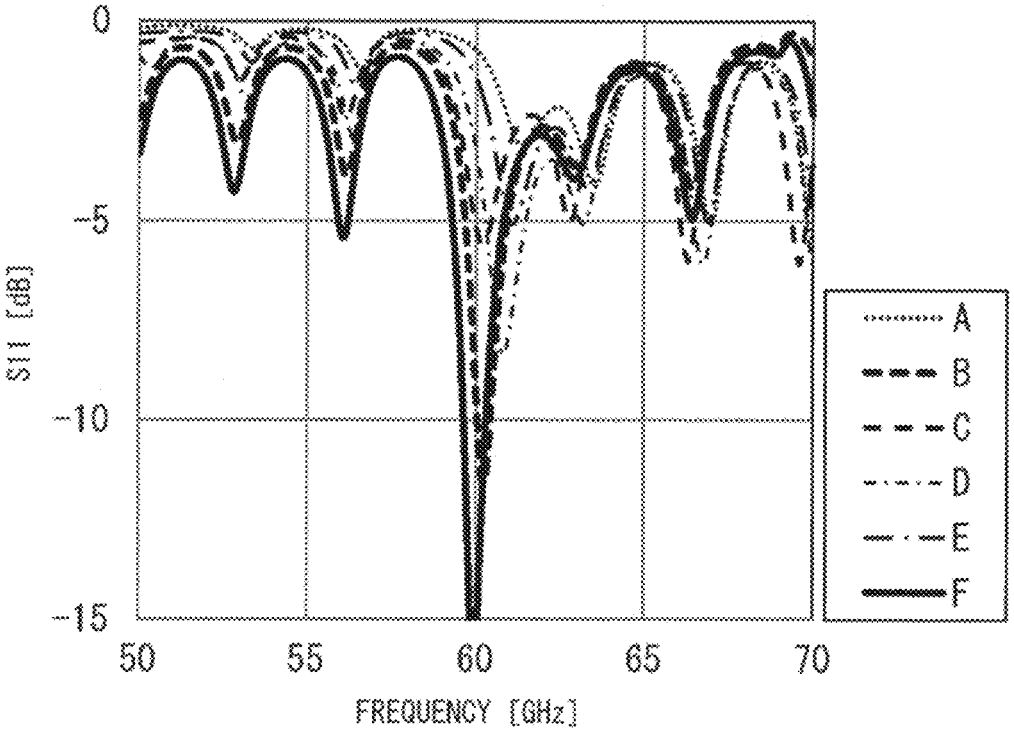

FIG. 8 is a graph showing reflection characteristics of the antennas illustrated in (a) to (f) of FIG. 7.

Figure 9:
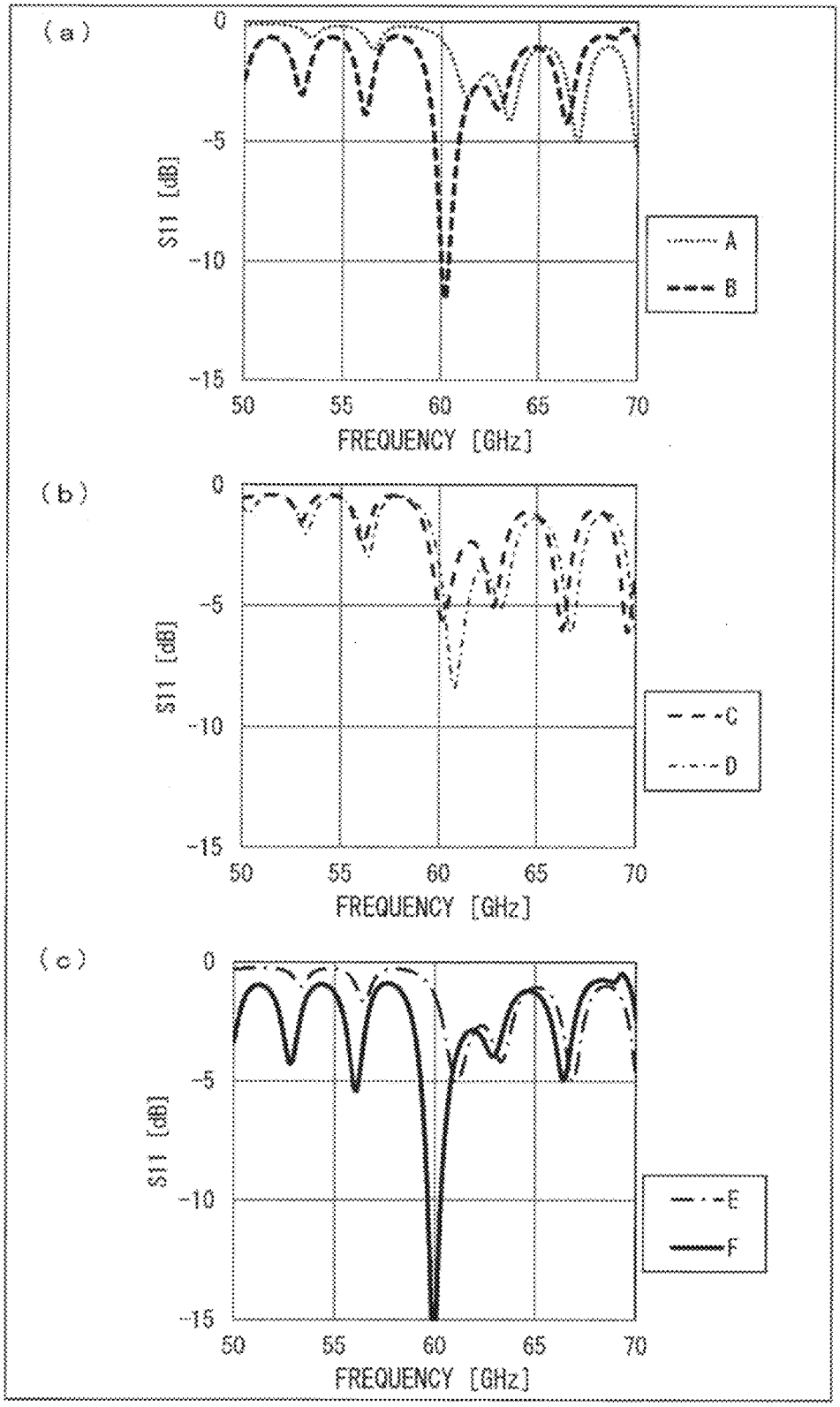

(a) of FIG. 9 is a graph showing reflection characteristics of the antennas illustrated in (a) and (b) of FIG. 7. (b) of FIG. 9 is a graph showing reflection characteristics of the antennas illustrated in (c) and (d) of FIG. 7. (c) of FIG. 9 is a graph showing reflection characteristics of the antennas illustrated in (e) and (f) of FIG. 7.

Figure 10:
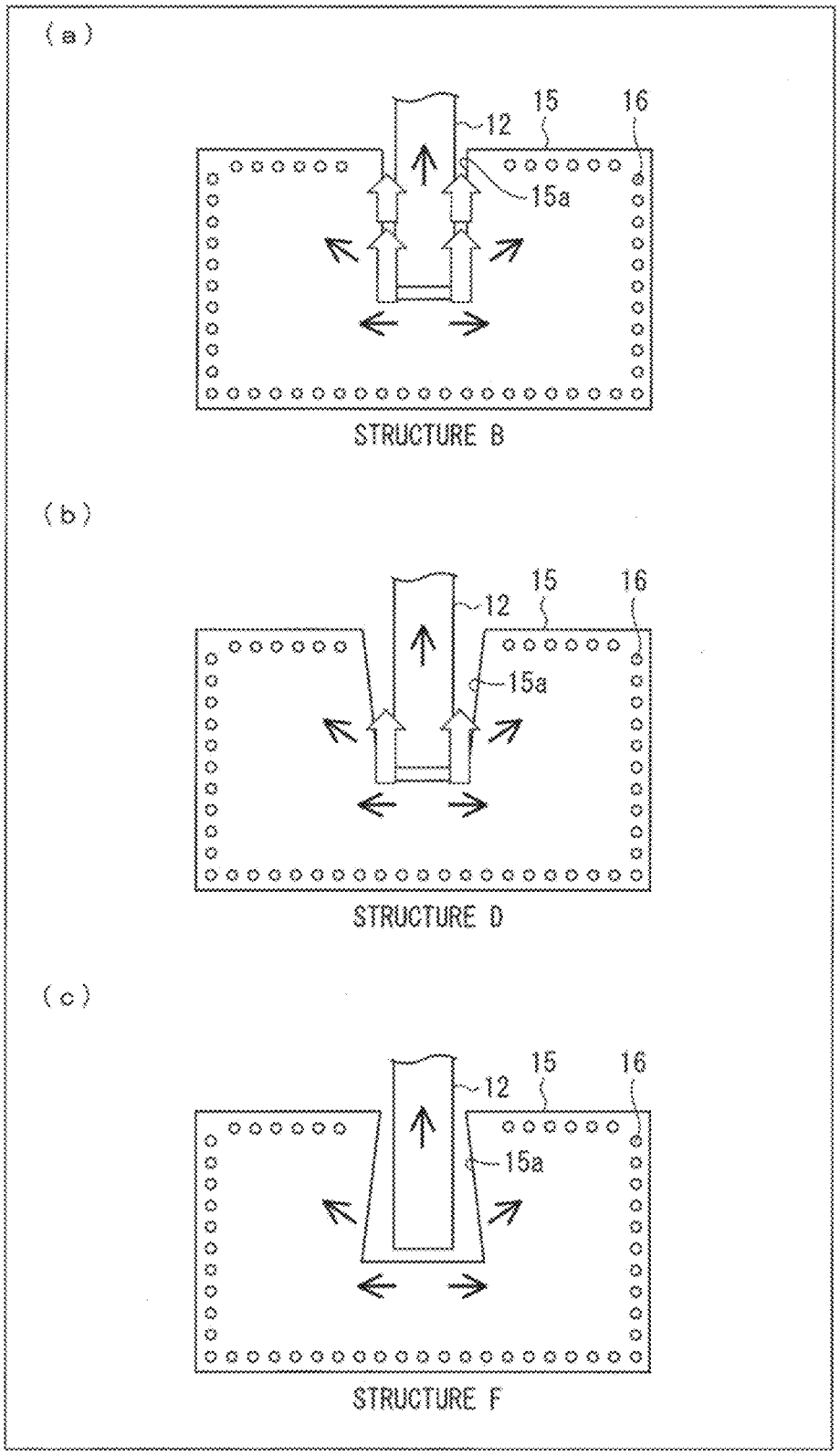

(a) of FIG. 10 is a plan view schematically illustrating a current distribution formed in the shield of the antenna illustrated in (b) of FIG. 7. (b) of FIG. 10 is a plan view schematically illustrating a current distribution formed in the shield of the antenna illustrated in (d) of FIG. 7. (c) of FIG. 10 is a plan view schematically illustrating a current distribution formed in the shield of the antenna illustrated in (f) of FIG. 7.

Figure 11:
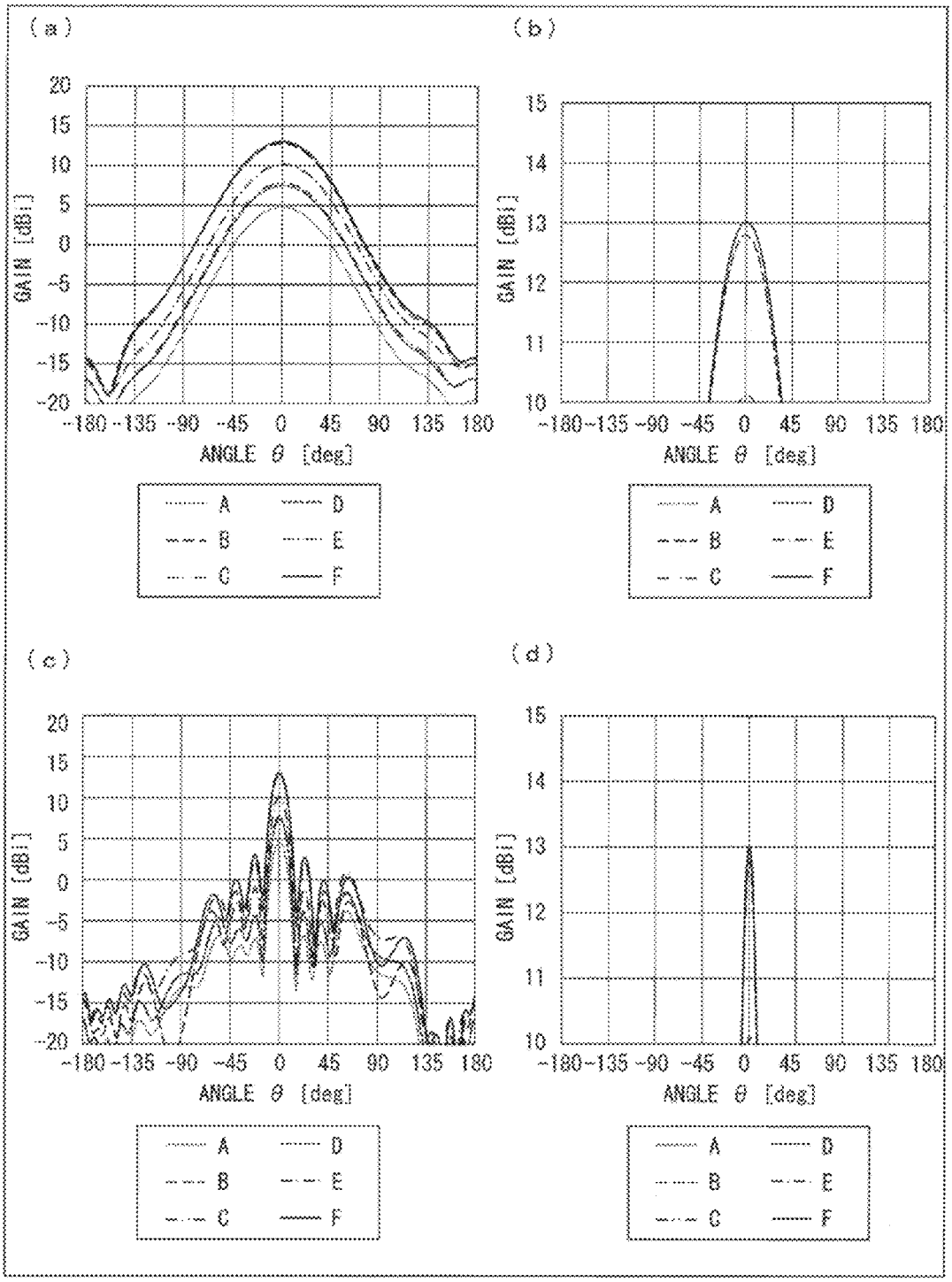

(a) of FIG. 11 is a graph showing radiation characteristics (z-x plane) of the antennas illustrated in (a) to (f) of FIG. 7. (b) of FIG. 11 is an enlarged graph of (a) of FIG. 11. (c) of FIG. 11 is a graph showing radiation characteristics (y-z plane) of the antennas illustrated in (a) to (f) of FIG. 7. (d) of FIG. 11 is an enlarged graph of (c) of FIG. 11.

Figure 12:
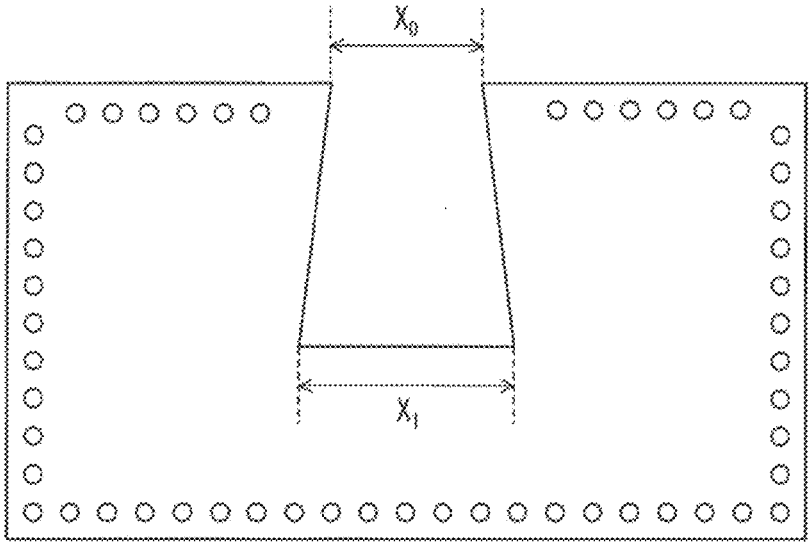

FIG. 12 is a plan view of the antenna in the Example, illustrating definitions of a width x0 of an open end of a cut and a width x1 of the cut at the deepest end of the cut.

Figure 13:
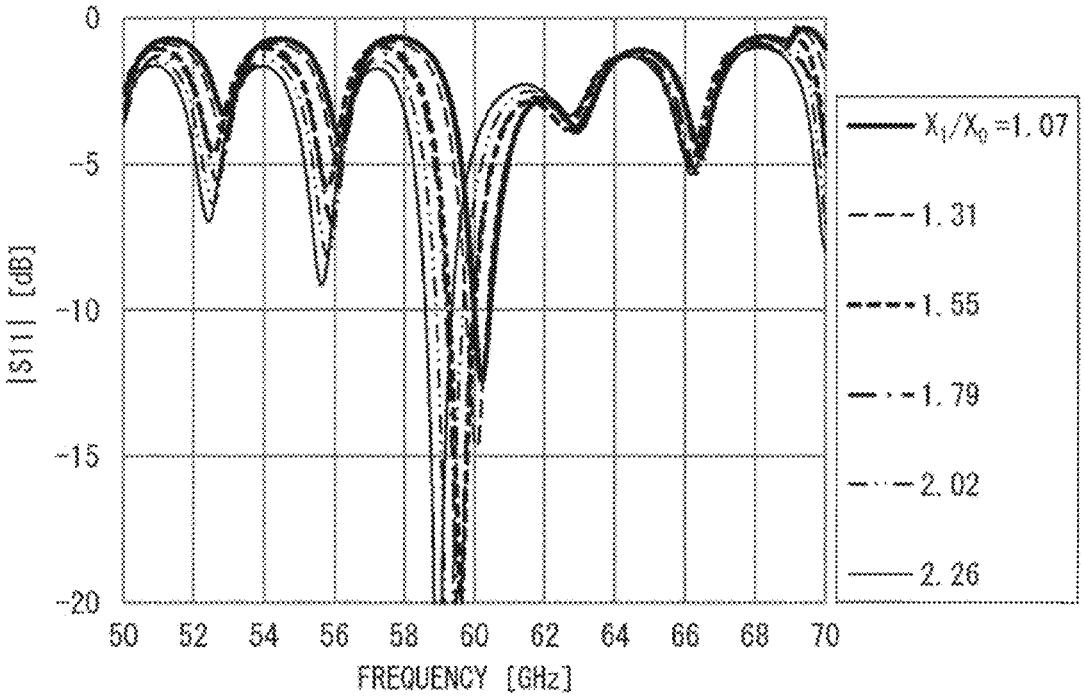

FIG. 13 is a graph showing reflection characteristics of the antenna in the Example in cases where the ratio x1/x0 is 1.07, 1.31, 1.55, 1.79, 2.02, and 2.26.

Figure 14:
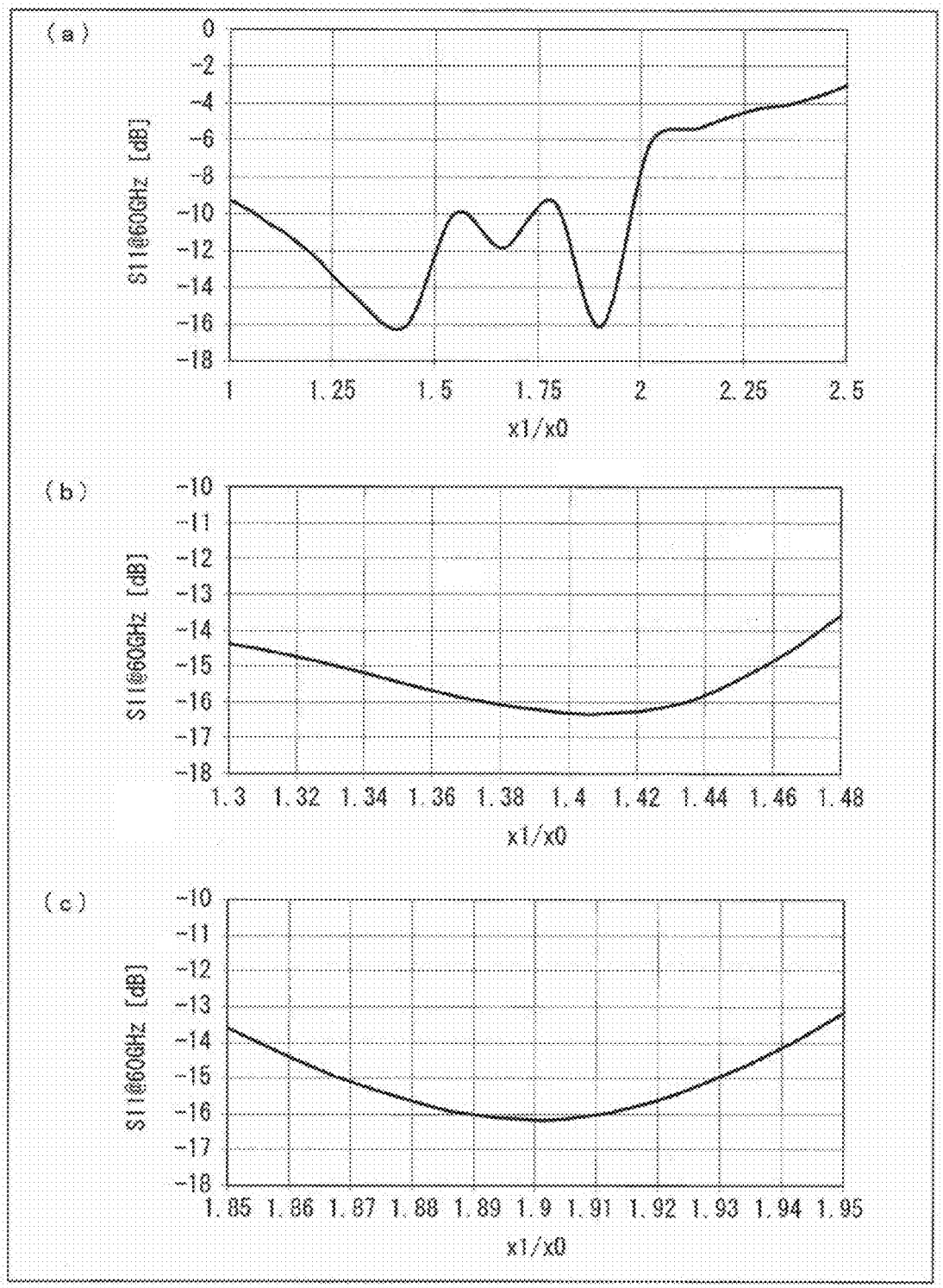

(a) of FIG. 14 is a graph showing how a reflection coefficient |S11| at 60 GHz of the antenna in the Example depends on the ratio x1/x0. (b) and (c) are enlarged graphs of (a) of FIG. 14.

Figure 15:
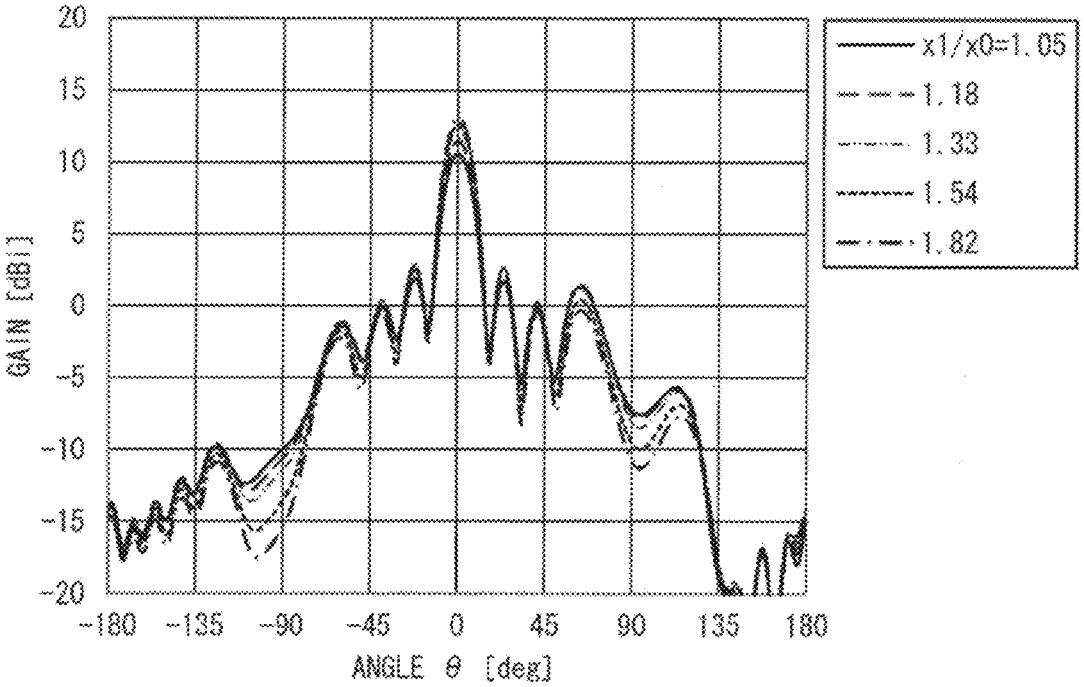

FIG. 15 is a graph showing radiation characteristics (y-z plane) of the antenna in the Example in cases where the ratio x1/x0 is set to 1.05, 1.18, 1.33, 1.54, and 1.82.

Figure 16:
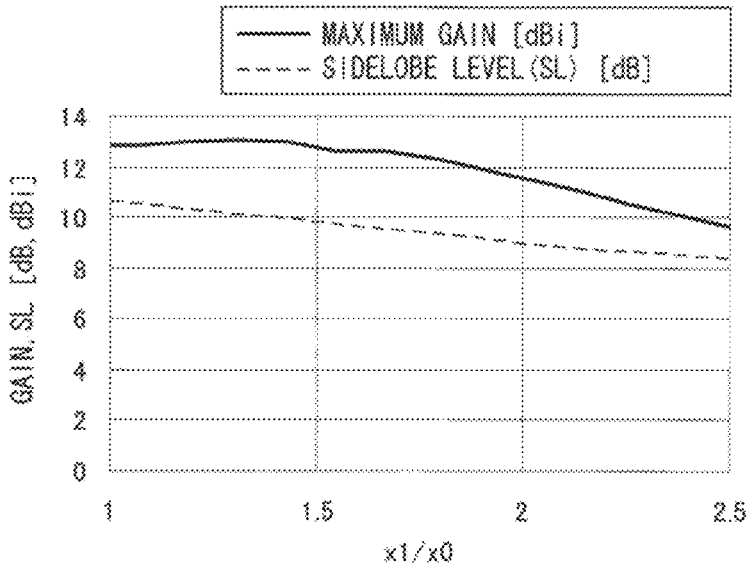

FIG. 16 is a graph showing how a maximum gain and a sidelobe level of the antenna in the Example depend on the ratio x1/x0.

Figure 17:
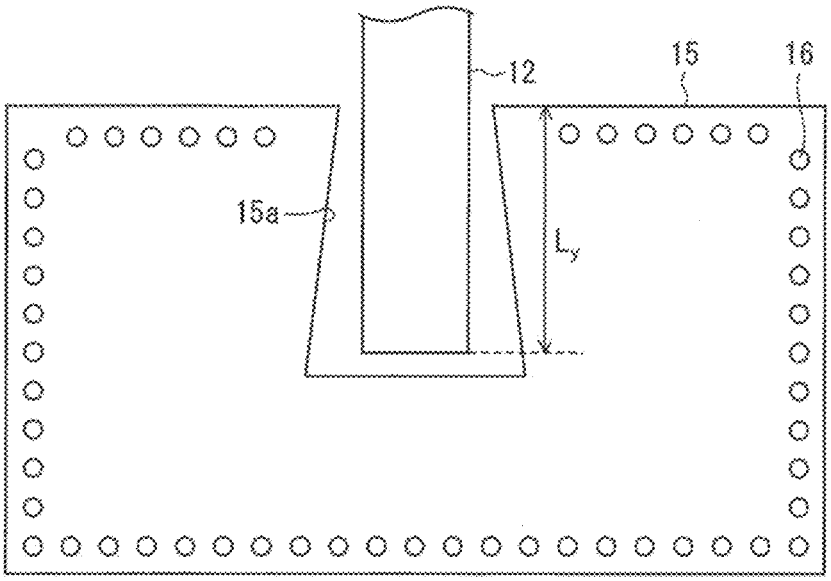

FIG. 17 is a plan view of the antenna in the Example, illustrating a definition of an insertion length Ly of a power feed line.

Figure 18:
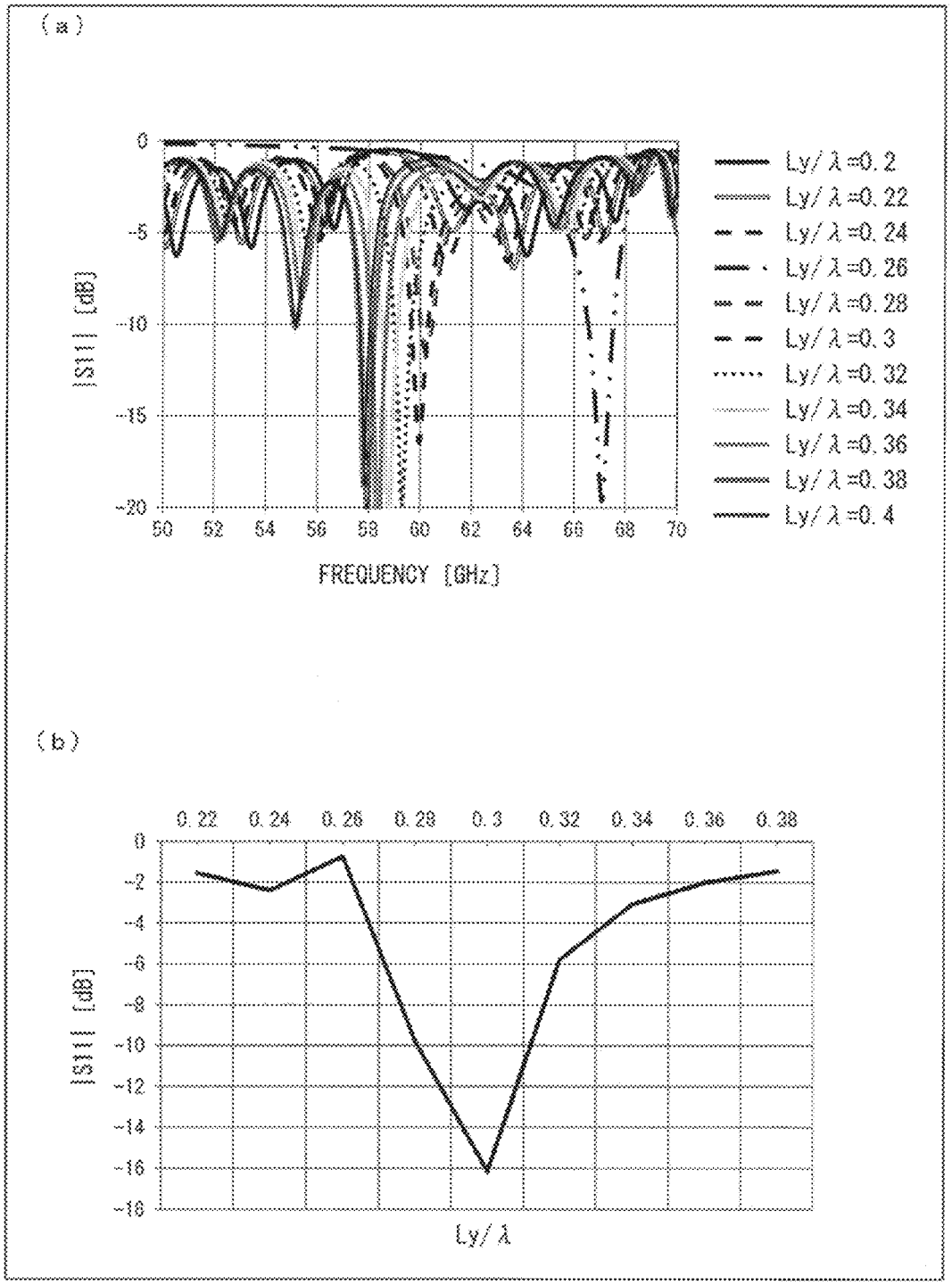

(a) of FIG. 18 is a graph showing reflection characteristics of the antenna in the Example in a case where a normalized insertion length Ly/λ is changed from 0.2 to 0.4 with an increment of 0.02 each time. (b) of FIG. 18 is a graph showing how the reflection coefficient |S11| at 60 GHz of the antenna in the Example depends on the normalized insertion length Ly/λ.

Figure 19:
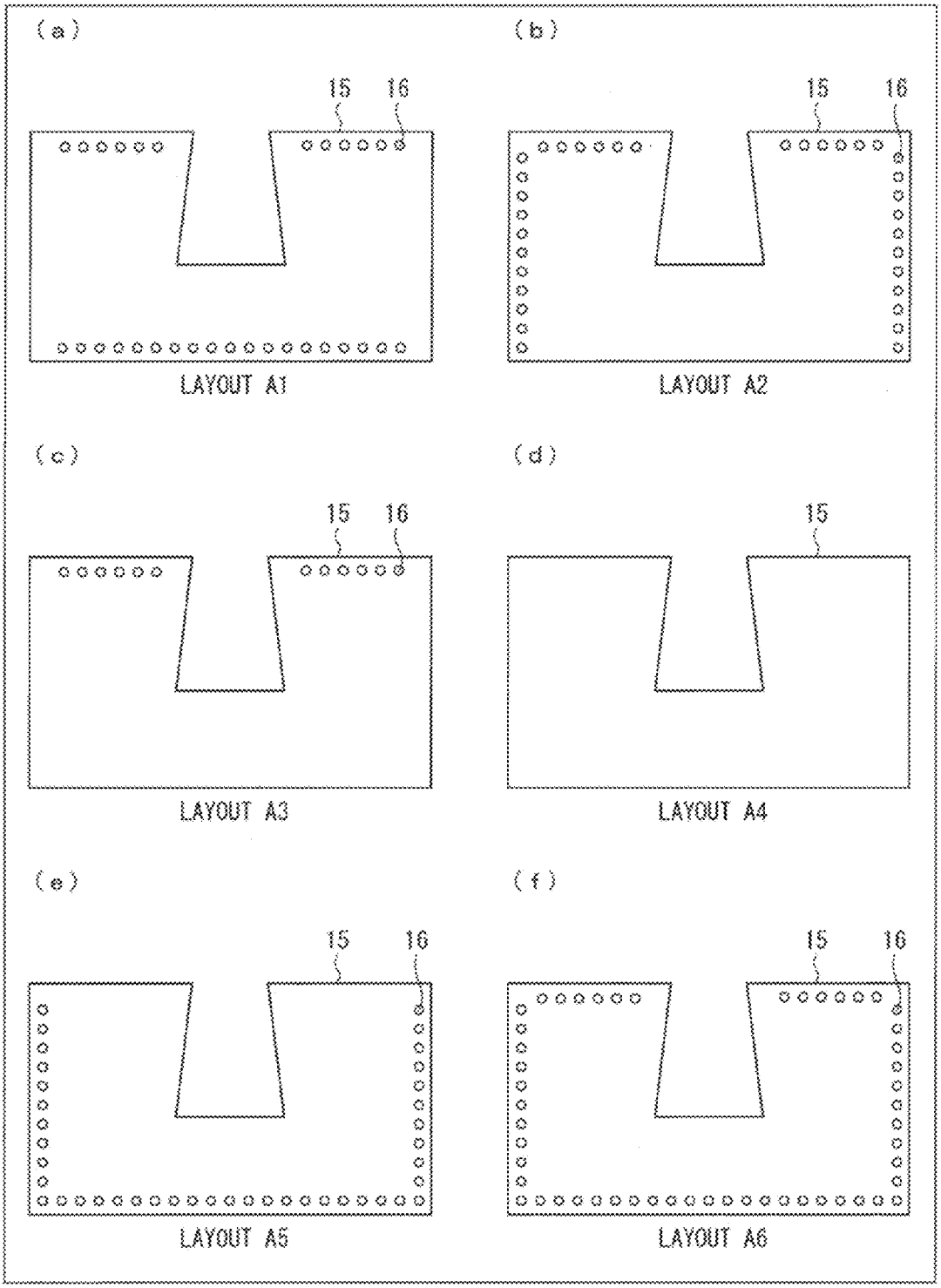

(a) to (e) of FIG. 19 are plan views of antennas in Comparative Examples. (f) of FIG. 19 is a plan view of the antenna in the Example. The antennas in the Comparative Examples are obtained by omitting some of short-circuit portions of the antenna in the Example.

Figure 20:
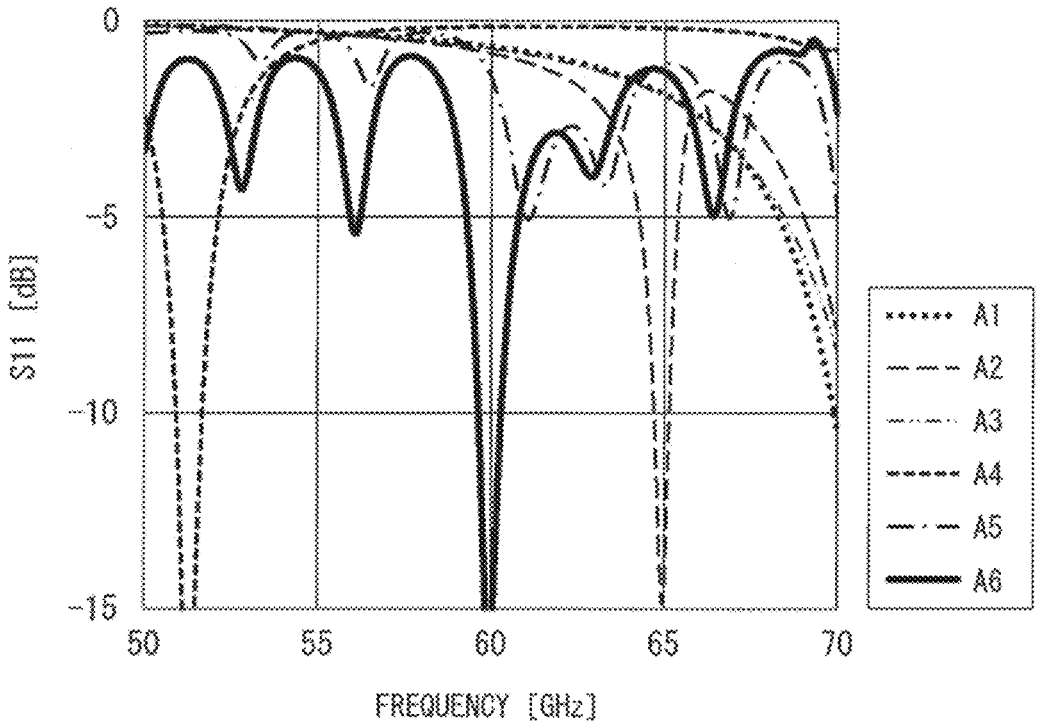

FIG. 20 is a graph showing reflection characteristics of the antennas illustrated in (a) to (f) of FIG. 19.

Figure 21:
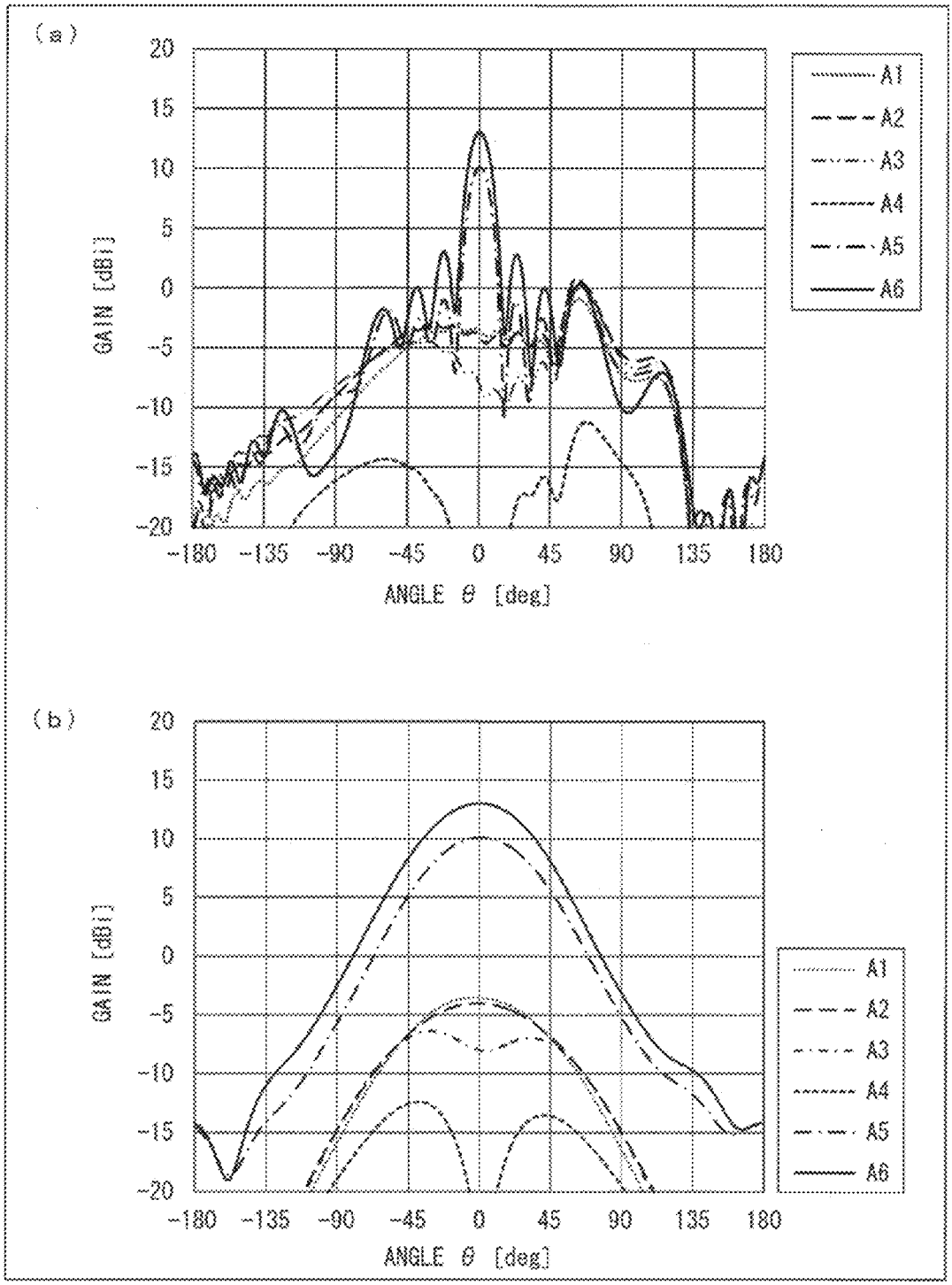

(a) of FIG. 21 is a graph showing radiation characteristics (y-z plane) of the antennas illustrated in (a) to (f) of FIG. 19. (b) of FIG. 21 is a graph showing radiation characteristics (z-x plane) of the antennas illustrated in (a) to (f) of FIG. 19.

Figure 22:
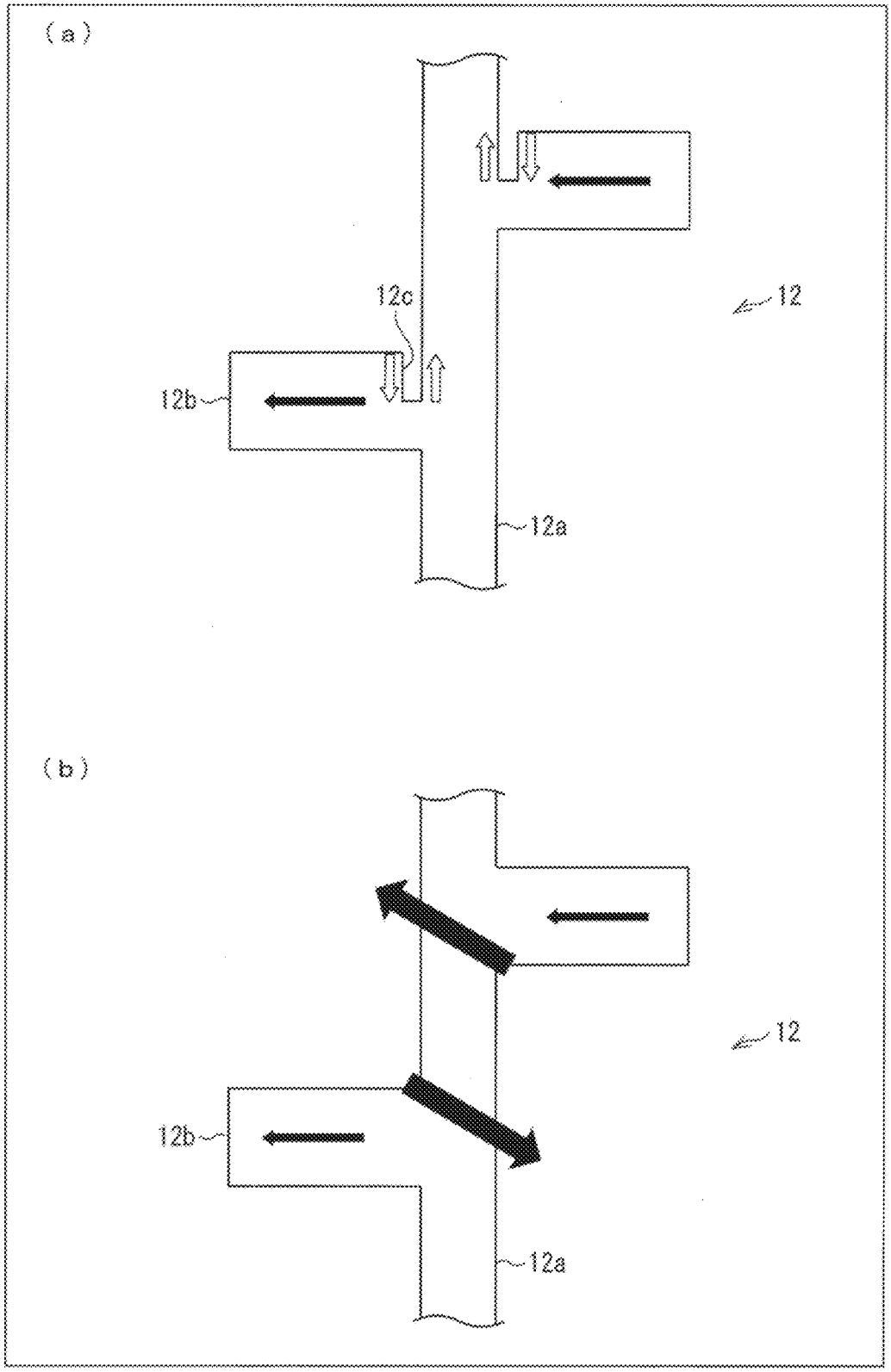

(a) of FIG. 22 is a plan view of the antenna in the Example. (b) of FIG. 22 is a plan view of the antenna in a Comparative Example. The antenna in the Comparative Example is obtained by omitting slits at roots of stubs of the antenna in the Example.

Figure 23:
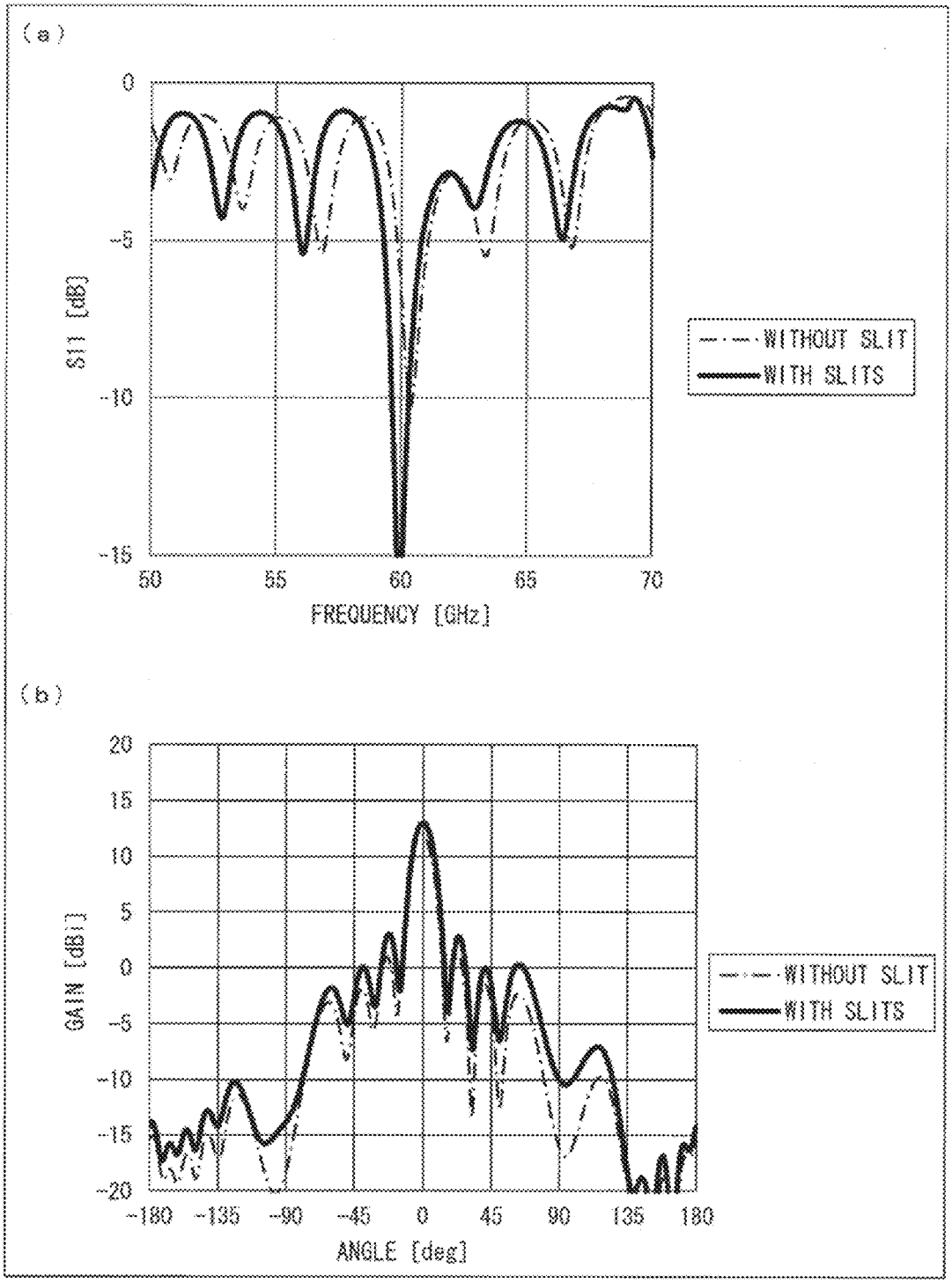

(a) of FIG. 23 is a graph showing respective reflection characteristics of the antennas illustrated in (a) and (b) of FIG. 22. (b) of FIG. 23 is a graph showing respective radiation characteristics (y-z plane) of the antennas illustrated in (a) and (b) of FIG. 22.

Figure 24:
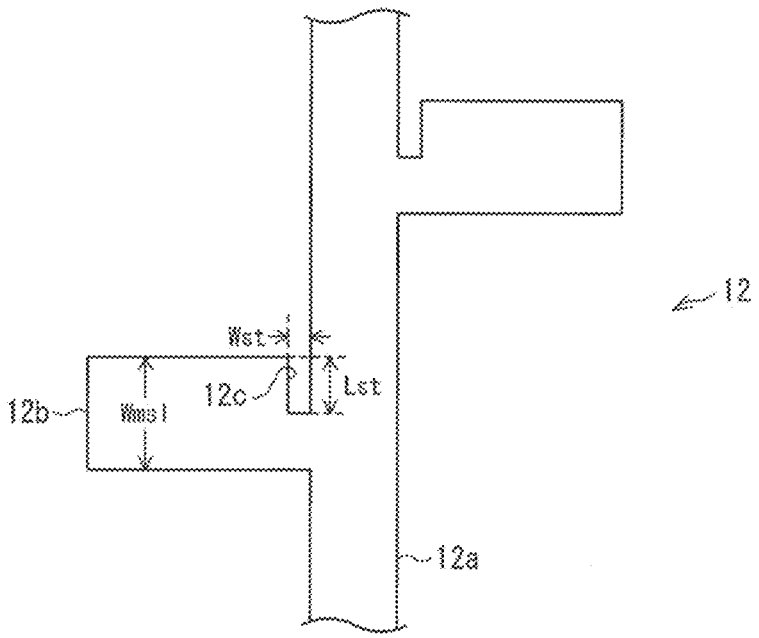

FIG. 24 is a plan view of the antenna in the Example, illustrating definitions of a width Wst and a depth Lst of a slit provided at a root of each stub and a width Wmsl of the each stub.

Figure 25:
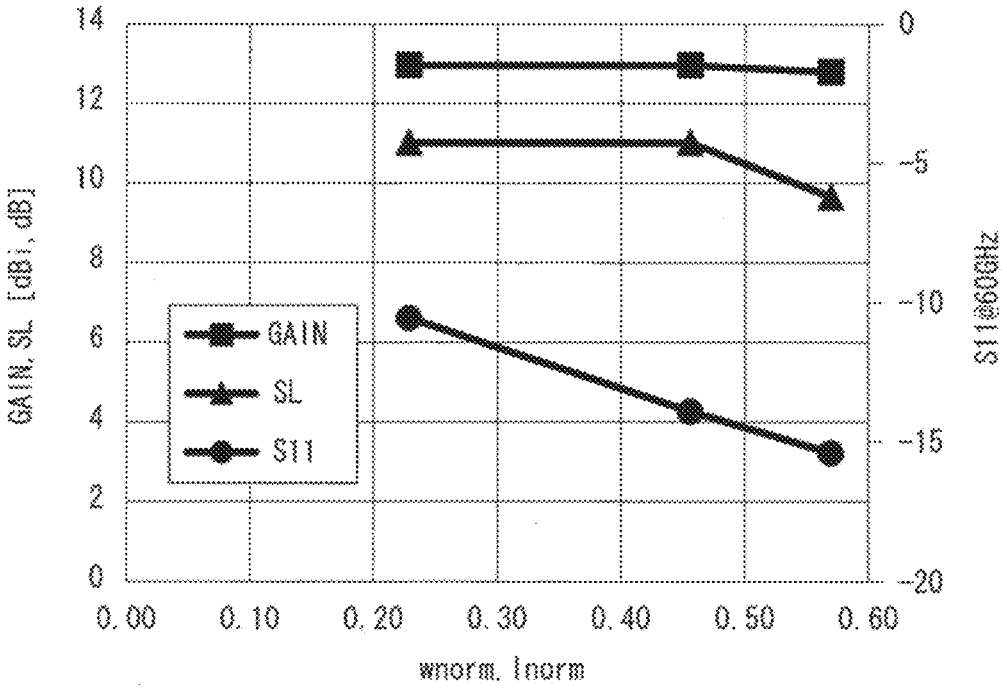

FIG. 25 is a graph showing how the reflection coefficient |S11|, the maximum gain, and the sidelobe level at 60 GHz of the antenna in the Example depend on Wnorm in a case where the slit at the root of the each stub has a square shape (Wnorm=Lnorm).

Figure 26:
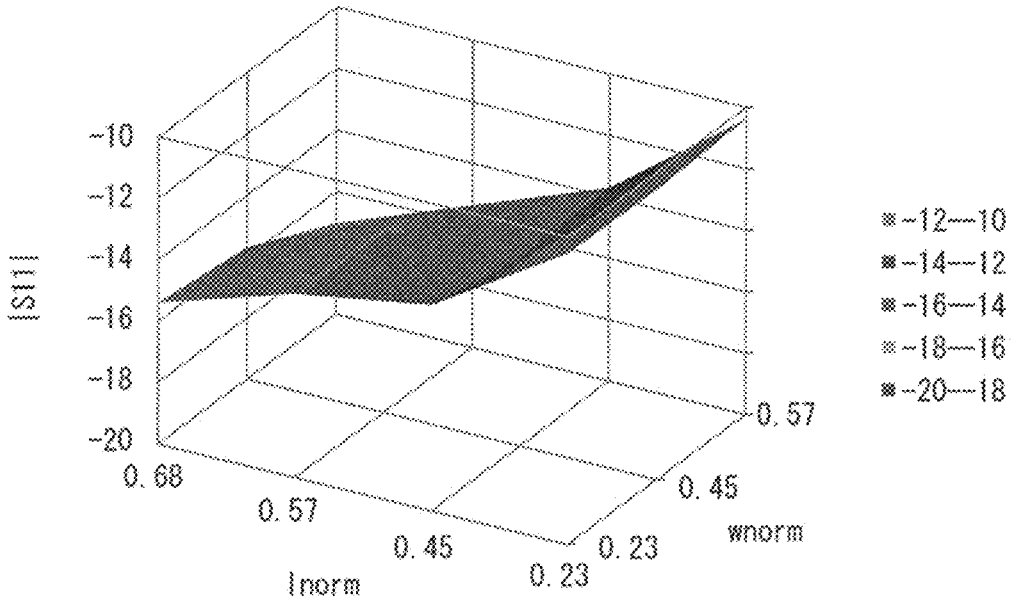

FIG. 26 is a graph showing how the reflection coefficient |S11| at 60 GHz of the antenna in the Example depends on Wnorm and Lnorm.

Figure 27:
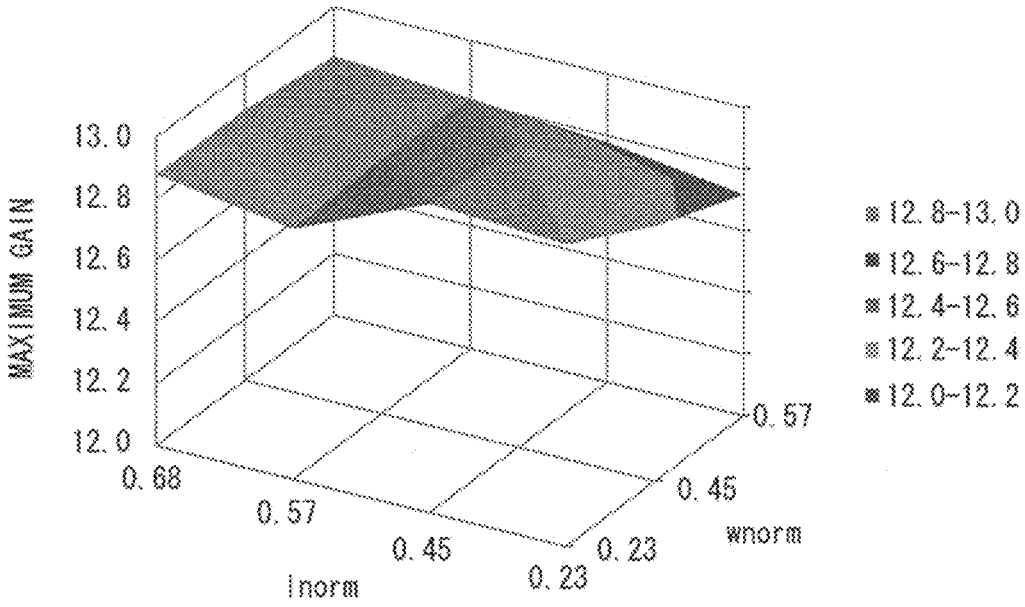

FIG. 27 is a graph showing how the maximum gain at 60 GHz of the antenna in the Example depends on Wnorm and Lnorm.

Figure 28:
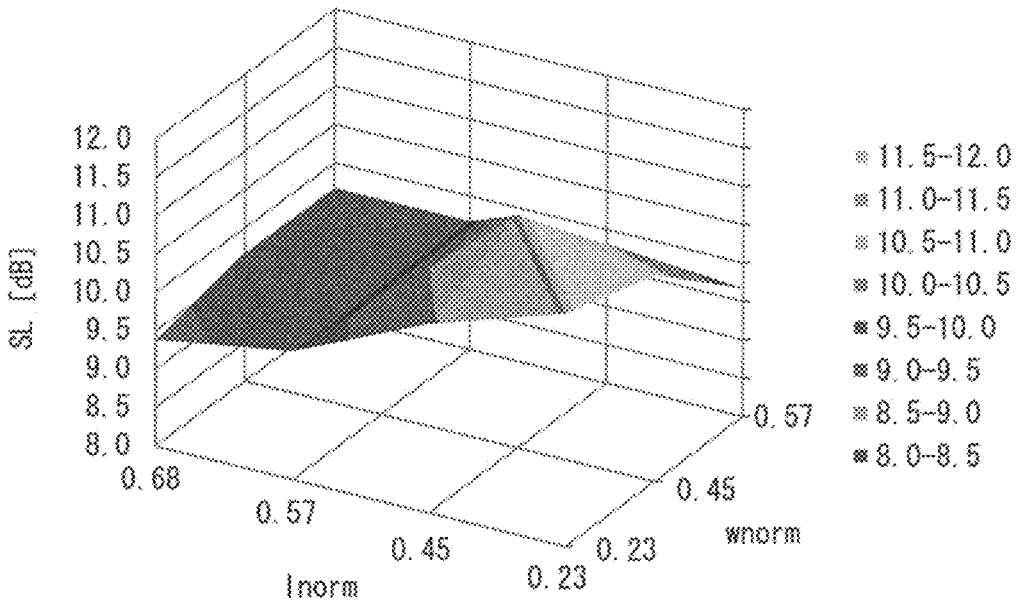

FIG. 28 is a graph showing how the sidelobe level at 60 GHz of the antenna in the Example depends on Wnorm and Lnorm.

Figure 29:
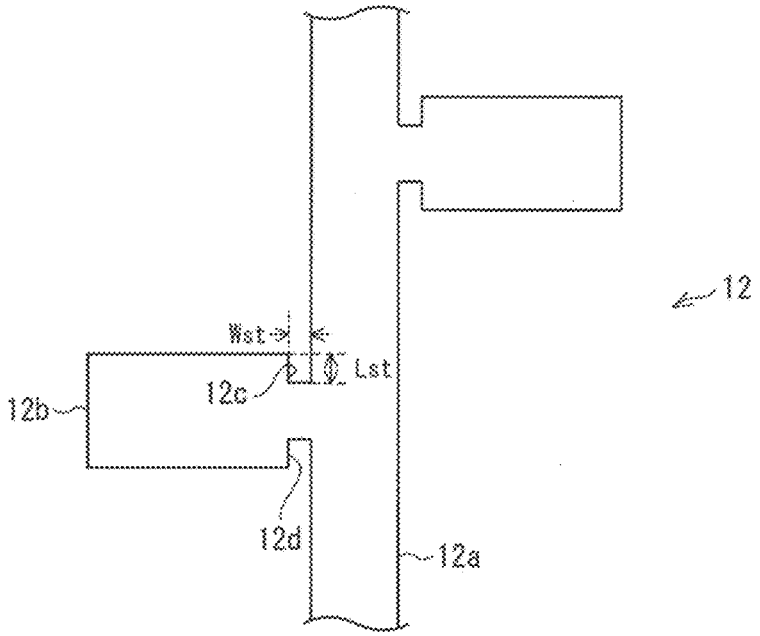

FIG. 29 is a plan view illustrating an antenna in which two slits are provided at a root of each stub.

Figure 30:
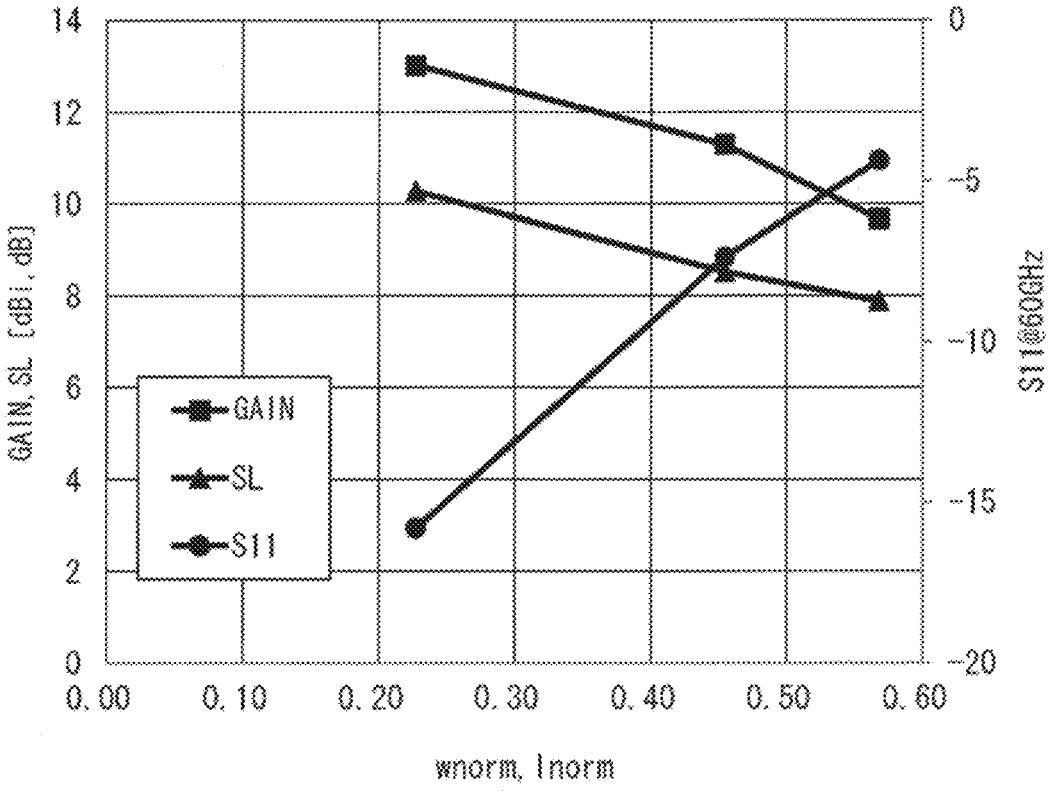

FIG. 30 is a graph showing how the reflection coefficient |S11|, the maximum gain, and the sidelobe level at 60 GHz depend on Wnorm in a case where each of the two slits provided at a root of each stub has a square shape (Wnorm=Lnorm).

DESCRIPTION OF EMBODIMENTS

[Arrangement of Antenna]

Figure 1:
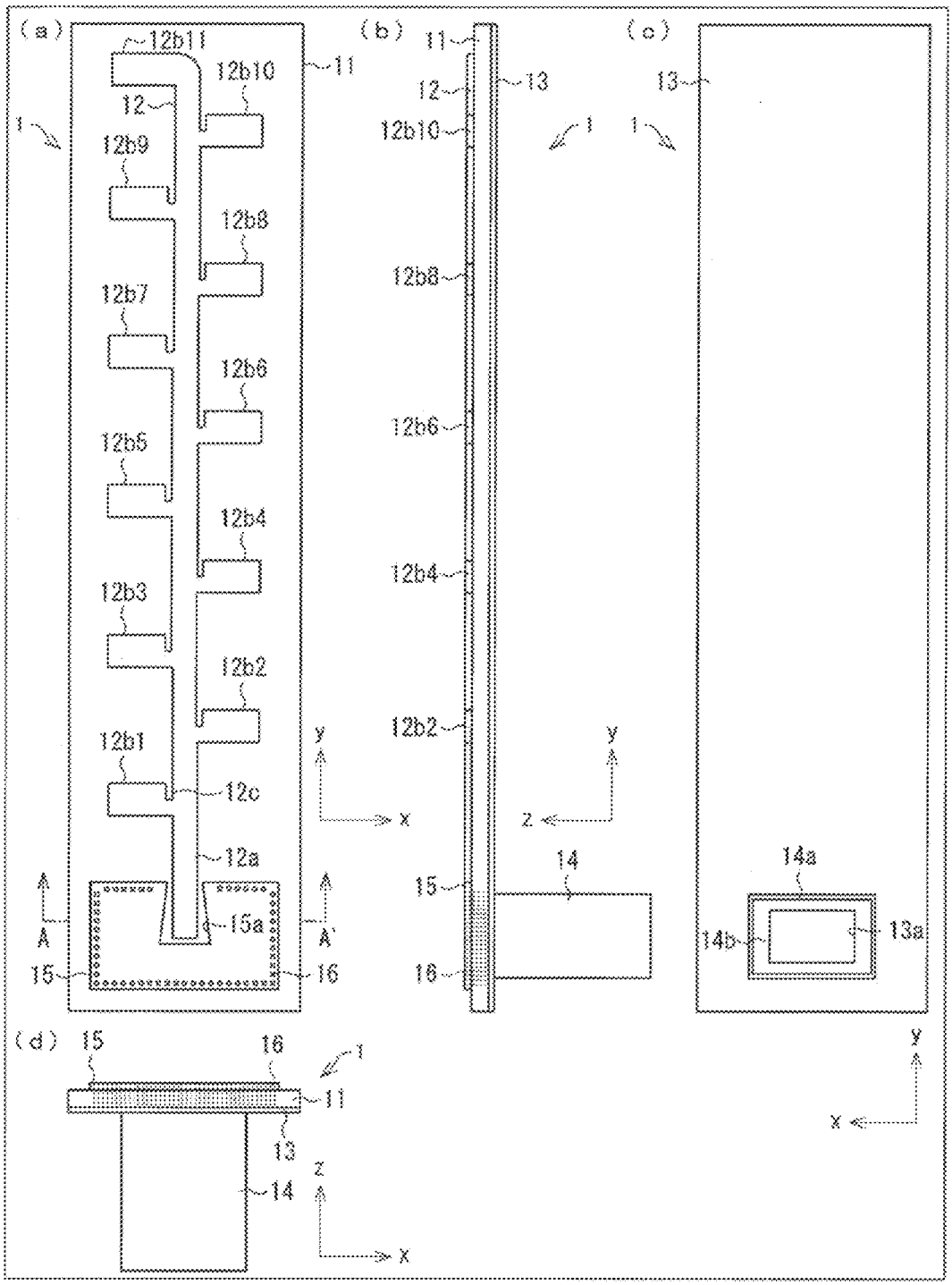

With reference to FIG. 1, the following discusses an arrangement of an antenna 1 in accordance with one embodiment of the present invention. (a) of FIG. 1 is a plan view of the antenna 1. (b) of FIG. 1 is a side view of the antenna 1. (c) of FIG. 1 is a bottom view of the antenna 1. (d) of FIG. 1 is an elevation view of the antenna 1.

The antenna 1 includes a dielectric substrate 11, an antenna conductor 12, a ground conductor 13, a waveguide tube 14, a shield 15, and short-circuit portions 16. The antenna 1 is produced by attaching the waveguide tube 14, the shield 15, and the short-circuit portions 16 to a microstrip antenna constituted by the dielectric substrate 11, the antenna conductor 12, and the ground conductor 13.

The dielectric substrate 11 is a plate member having a rectangular main surface, and is made of a dielectric such as resin. In the present embodiment, an LCP (Liquid Crystal Polymer) substrate made of a liquid crystal polymer is used as the dielectric substrate 11.

In the present specification, among six surfaces forming an entire surface of the dielectric substrate 11, each of two surfaces having the largest area is referred to as a "main surface", and each of the other four surfaces is referred to as a "side surface". In a case where it is necessary to distinguish between the two main surfaces of the dielectric substrate 11, one of the two main surfaces is referred to as a "front surface" and the other one is referred to as a "back surface". Further, the present specification employs a coordinate system in which an x-axis is an axis parallel to a short side of a main surface of the dielectric substrate 11, a y-axis is an axis parallel to a long side of the main surface of the dielectric substrate 11, and a z-axis is an axis orthogonal to the main surface of the dielectric substrate 11.

The antenna conductor 12 is a foil member provided on a front surface of the dielectric substrate 11, and is made of a conductor such as metal. In the present embodiment, copper foil provided on the front surface of the dielectric substrate 11 is used as the antenna conductor 12.

The antenna conductor 12 is a comb-line antenna conductor in which a plurality of open stubs (hereinafter simply referred to as "stub") **12*b*1 through 12*b*11 are attached to a power feed line 12*a***.

The power feed line **12*a* is a strip-shaped conductor serving as a stem of the antenna conductor 12, and extends in parallel to the y-axis. The power feed line 12*a* constitutes a microstrip line, together with the ground conductor 13 which faces the power feed line 12*a* via the dielectric substrate 11. An electromagnetic wave having entered an input end of the power feed line 12*a* (an end of the power feed line 12*a* on a negative side of the y-axis) propagates inside the microstrip line toward an output end of the power feed line 12*a* (an end of the power feed line 12*a*** on a positive side of the y-axis).

The stubs **12*b*1 through 12*b*11 are strip-shaped conductors serving as branches of the antenna conductor 12, and extend in parallel to the x-axis. The stubs 12*b*1 through 12*b*11 include ones extending from the power feed line 12*a*** in a negative direction of the x-axis (ones each having an odd number as the last number of a reference sign) and ones extending from the power feed line 12*a* in a positive direction of the x-axis (ones each having an even number as the last number of a reference sign). The former ones and the latter ones are provided alternately along the power feed line 12*a*. Each of the stubs 12*b*1 through 12*b*10 has, at a root of the each stub, a slit 12*c* extending in a direction from an output-end side of the power feed line 12*a* toward an input-end side of the power feed line 12*a*. The electromagnetic wave having propagated through the microstrip line constituted by the power feed line 12*a* and the ground conductor 13 is radiated from each of the stubs 12*b*1 through 12*b*11 to the outside.

The ground conductor 13 is a foil member provided on the back surface of the dielectric substrate 11, and is made of a conductor such as metal. In the present embodiment, copper foil provided on the back surface of the dielectric substrate 11 is used as the ground conductor 13.

The ground conductor 13 has an opening 13*a*. The opening 13*a* has a rectangular shape whose long side is parallel to the x-axis. The opening 13*a* is provided, to the back surface of the dielectric substrate 11, in a region overlapping the input end of the power feed line 12*a*. The ground conductor 13 entirely covers the back surface of the dielectric substrate 11 except for this region.

The waveguide tube 14 is a tubular member whose both ends are open, and is made of a conductor such as metal. The waveguide tube 14 has a cavity 14*b* inside the waveguide tube 14. The cavity 14*b* has a lateral cross section (cross section orthogonal to the tube axis) which is rectangular. The waveguide tube 14 is provided in such a manner that the tube axis is parallel to the z-axis and a long side axis of the lateral cross section of the cavity 14*b* is parallel to the x-axis. Further, the waveguide tube 14 has an edge surface of a tube wall 14*a* on a positive side of the z-axis which edge surface is joined to the ground conductor 13. An image of the cavity 14*b* orthogonally projected onto the x-y plane includes an image of the opening 13*a* orthogonally projected onto the x-y plane.

The shield 15 is a foil member provided on the front surface of the dielectric substrate 11, and is made of a conductor such as metal. In the present embodiment, copper foil provided on the front surface of the dielectric substrate 11 is used as the shield 15.

The shield 15 has a rectangular shape which has long sides parallel to the x-axis, from one of which long side on the positive side of the y-axis a cut is formed. The cut 15*a* extends from this long side of the shield 15 on the positive side of the y-axis toward the negative side of the y-axis. The shield 15 is provided in such a manner that the input end of the power feed line 12*a* comes into the cut 15*a*. If the cut 15*a* were not present, an image of the shield 15 orthogonally projected onto the x-y plane would include the image of the cavity 14*b* orthogonally projected onto the x-y plane.

The shield 15 is short-circuited with the ground conductor 13 via a plurality of short-circuit portions 16 which penetrate the dielectric substrate 11. These short-circuit portions 16 are provided along a whole periphery of the shield 15 except for a portion provided with the cut 15*a*, so as to constitute a fence surrounding a region overlapping the opening 13*a* inside the dielectric substrate 11.

The antenna 1 is supplied with an electromagnetic wave via the waveguide tube 14. A TE01 mode electromagnetic wave propagates through the waveguide tube 14 in a positive direction of the z-axis and then enters into the dielectric substrate 11 via the opening 13*a* of the ground conductor 13. The region inside the dielectric substrate 11 which region overlaps the opening 13*a* has sides surrounded by the short-circuit portions 16 and a top covered with the shield 15. Consequently, the electromagnetic wave having entered into the dielectric substrate 11 via the opening of the ground conductor 13 enters the input end of the power feed line 12*a* without being scattered and lost.

The antenna 1 is characterized in that the cut 15*a* made in the shield 15 has a reverse-taper shape whose width becomes greater from an open end of the cut 15*a* to an inward end of the cut 15*a*. Designing the cut 15*a* to have a reverse-taper shape makes it possible to improve reflection characteristics and radiation characteristics of the antenna 1.

In the present embodiment, the cut 15*a* is designed to have a shape tapered with an exponential function of a position in a long-side direction whose base is Napier's constant e. However, the shape of the cut 15 is not limited to this. For example, the cut 15 may be designed to have a linear taper shape whose width is in proportion to a distance from the open end of the cut 15 or a parabolic taper shape whose width is in proportion to a square root of a distance from the open end.

Figure 2:
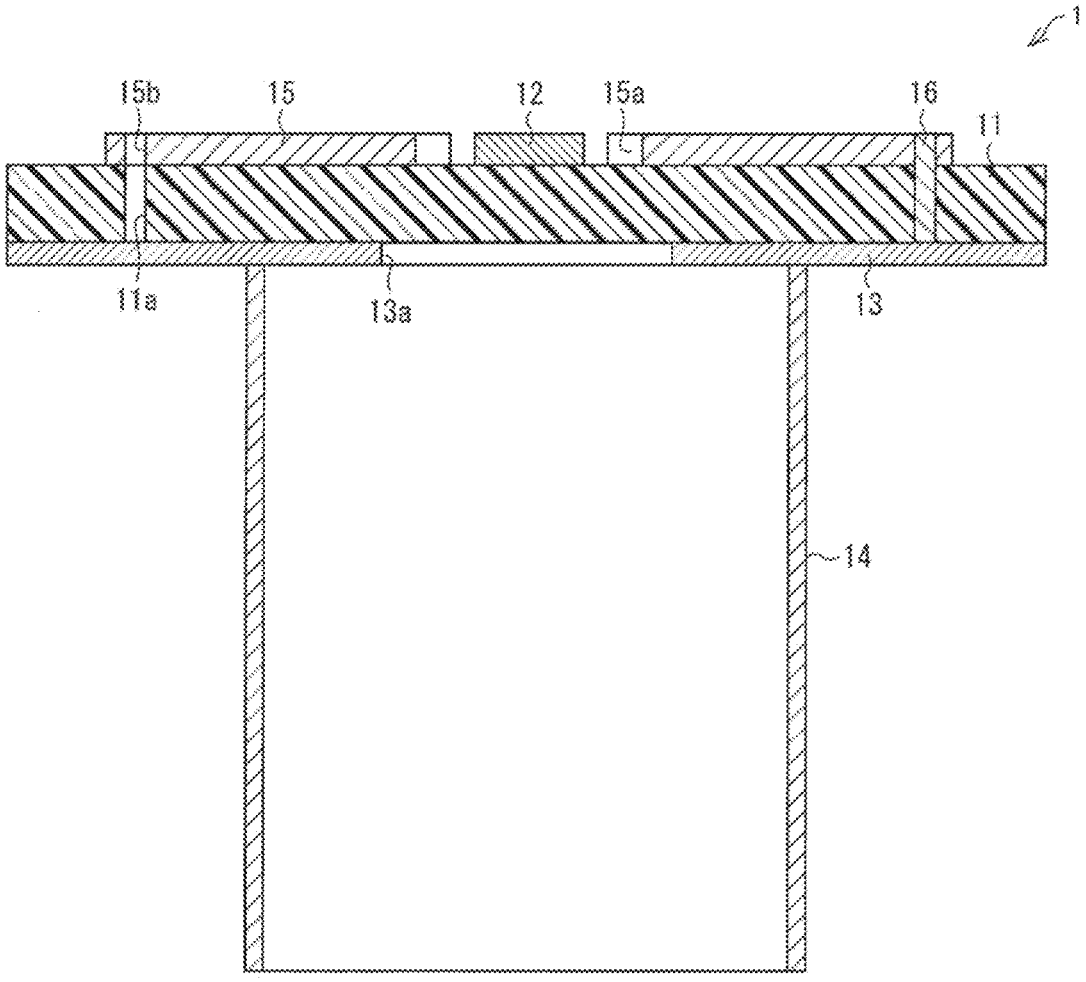
FIG. 2 is a cross sectional view taken along a line AA' of the antenna in accordance with the embodiment.

The following provides a supplemental description of the structure of the short-circuit portions 16 with reference to FIG. 2. FIG. 2 is a cross sectional view taken along a line AA' of the antenna 1.

As illustrated in FIG. 2, the shield 15 has an opening 15*b*. Furthermore, as illustrated in FIG. 2, the dielectric substrate 11 has a through hole 11*a* which communicates with the opening 15*b*.

The opening 15*b* and the through hole 11*a* are filled with a conductor such as solder. The conductor with which the opening 15*b* and the through hole 11*a* are filled contacts with both of the shield 15 and the ground conductor 13, thereby short-circuiting the shield 15 and the ground conductor 13. The short-circuit portions 16 are each precisely a conductor with which the opening 15*b* and the through hole 11*a* are filled as above.

[Examples]

With reference to FIGS. 3 through 6, the following discusses an example of the antenna 1 illustrated in FIG. 1.

The antenna 1 in the present Example is obtained by attaching the waveguide tube 14, the shield 15, and the short-circuit portions 16 to a microstrip antenna (constituted by the dielectric substrate 11, the antenna conductor 12, and the ground conductor 13) which operates at 60 Hz. Specifically, individual sections of the antenna 1 illustrated in FIG. 1 are set to have sizes illustrated in FIGS. 3 and 4.

Figure 3:
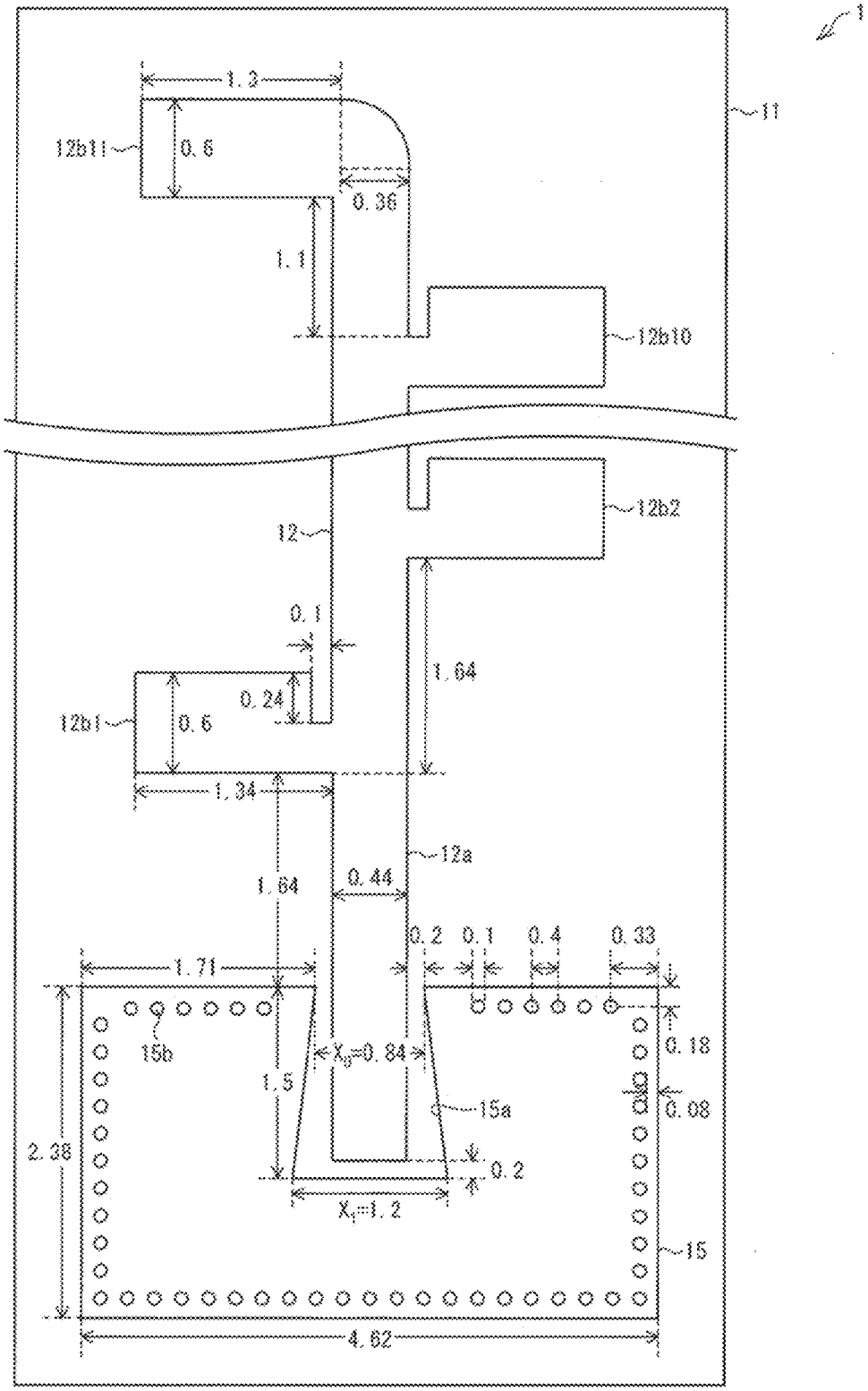
FIG. 3 is a plan view illustrating sizes of respective portions of the antenna in an Example.
Figure 4:
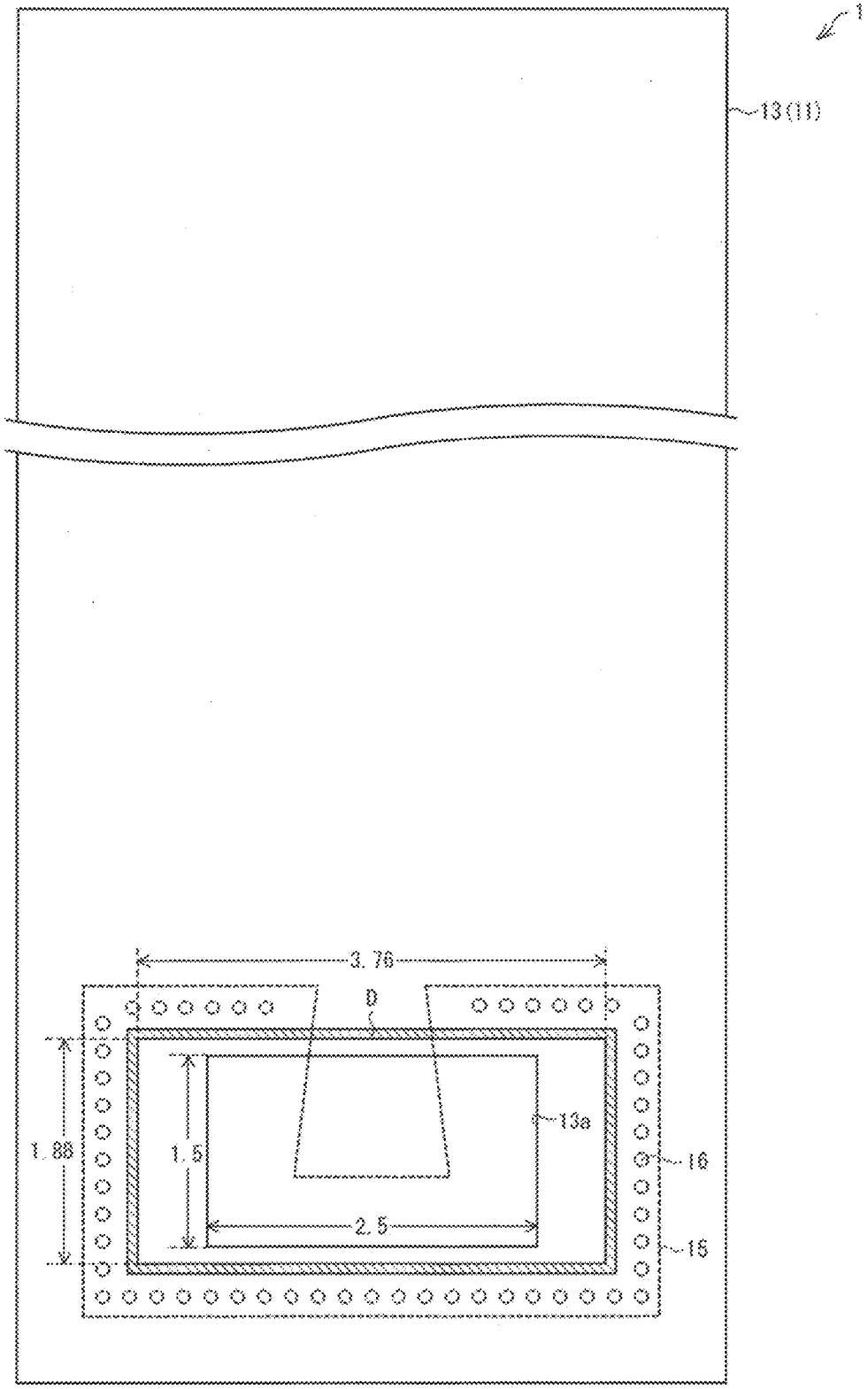
FIG. 4 is a bottom view illustrating sizes of respective portions of the antenna in the Example.

FIG. 3 is a plan view illustrating sizes (unit: mm) of individual sections of the antenna 1 in the present Example. FIG. 4 is a bottom view illustrating sizes (unit: mm) of individual sections of the antenna 1 in the present Example. In the antenna 1 in the present Example, the dielectric substrate 11 has a thickness of 0.175 mm, and the waveguide tube 14 has a length of 2.00 mm. Furthermore, in the antenna 1 in the present Example, the dielectric substrate 11 has a specific inductive capacity of 3.0 and a dielectric dissipation factor of 0.0025.

Figure 5:
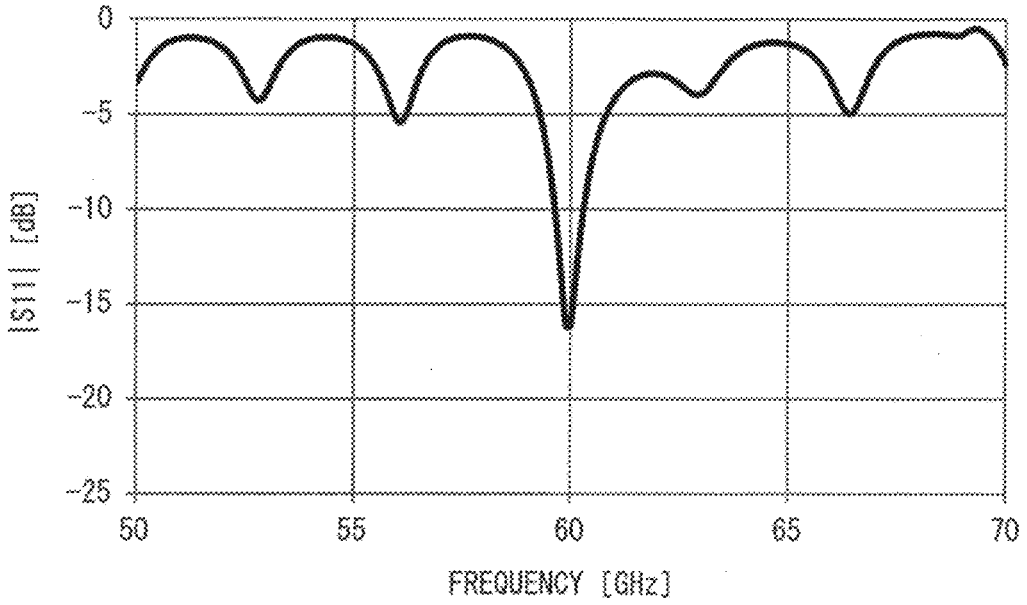
FIG. 5 is a graph showing a reflection characteristic of the antenna in the Example.

FIG. 5 is a graph showing a reflection characteristic (frequency dependency of a reflection coefficient |S11|) of the antenna 1 in the present Example. It is confirmed from FIG. 5 that the reflection coefficient |S11| at 60 GHz is −14.5 dB, which is smaller than a designed target value of −10 dB.

Figure 6:
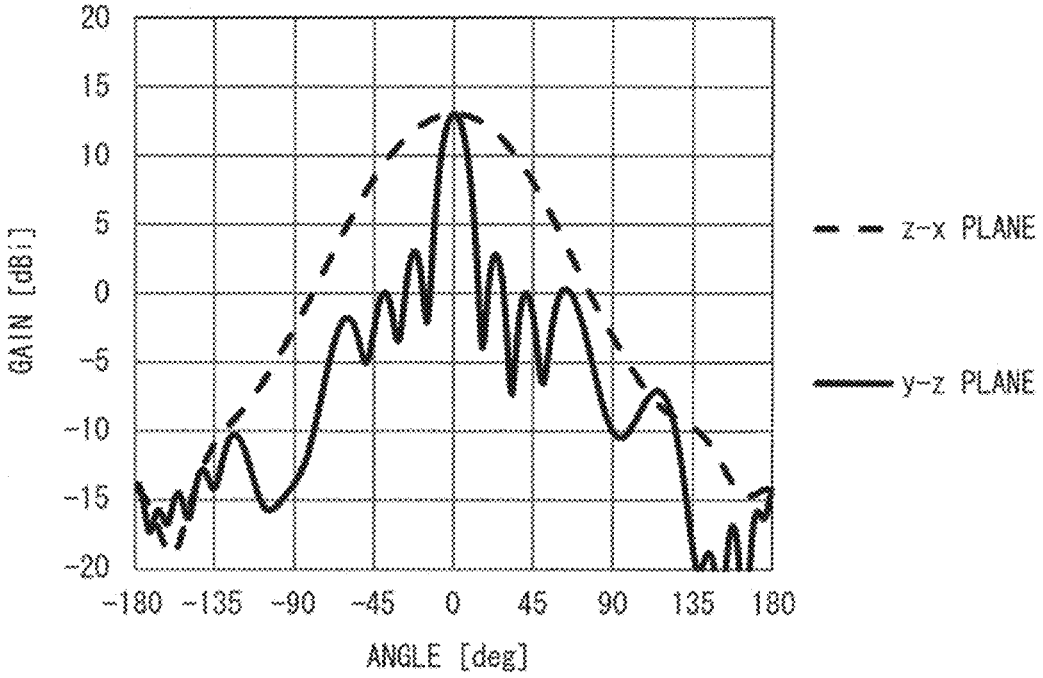
FIG. 6 is a graph showing radiation characteristics of the antenna in the Example.

FIG. 6 is a graph showing radiation characteristics (direction dependency of a gain in y-z and z-x planes) at 60 GHz of the antenna 1. It is confirmed from FIG. 6 that (1) a maximum gain is 13.0 dBi, which is larger than a designed target value of 10 dBi, and (2) a sidelobe level is 9.97 dBi, which is substantially equal to a designed target value of 10 dBi.

[Influences of Deformation of Cut and Omission of Short-Circuit Portions on Characteristics]

With reference to FIGS. 7 through 11, the following discusses influences of deformation of the cut 15*a* and omission of the short-circuit portions 16 on the reflection characteristics and the radiation characteristics of the antenna 1 in the present Example.

The following discusses a group of antennas and compares characteristics of the antennas.

Antenna A: an antenna, as illustrated in (a) of FIG. 7, obtained by (i) changing the shape of the cut 15*a* into a rectangular shape whose width is 0.84 mm and (ii) omitting some of the short-circuit portions 16, in the antenna 1 of the present Example.

Antenna B: an antenna, as illustrated in (b) of FIG. 7, obtained by changing the shape of the cut 15*a* into a rectangular shape whose width is 0.84 mm in the antenna 1 in the present Example.

Antenna C: an antenna, as illustrated in (c) of FIG. 7, obtained by (i) changing the shape of the cut 15*a* into a taper shape whose width x0 at the open end of the cut 15*a* is 1.1 mm and whose width x1 at the inward end of the cut 15*a* is 0.84 mm and (ii) omitting some of the short-circuit portions 16, in the antenna 1 in the present Example.

Antenna D: an antenna, as illustrated in (d) of FIG. 7, obtained by changing the shape of the cut 15*a* into a taper shape whose width x0 at the open end is 1.1 mm and whose width x1 at the inward end is 0.84 mm, in the antenna 1 in the present Example.

Antenna E: an antenna, as illustrated in (e) of FIG. 7, obtained by (i) changing the shape of the cut 15*a* into a reverse-taper shape whose width x0 at the open end is 0.84 mm and whose width x1 at the inward end is 1.2 mm and (ii) omitting some of the short-circuit portions 16, in the antenna 1 in the present Example.

Antenna F: the antenna 1 in the present Example (see (f) of FIG. 7).

FIG. 8 is a graph showing reflection characteristics of these antennas A through F.

It is confirmed in comparison of the reflection characteristics of the antennas B, D, and F in FIG. 8 that only the antenna F (the antenna 1 in the present Example) has a reflection coefficient |S11| at 60 GHz lower than the designed target value of −10 dB. That is, in order to obtain an excellent reflection characteristic at 60 GHz, it is preferable to design the cut 15*a* so that the cut 15*a* may have a reverse-taper shape as in the antenna 1 in the present Example.

(a) of FIG. 9 is a graph showing respective reflection characteristics of the antennas A and B. (b) of FIG. 9 is a graph showing respective reflection characteristics of the antennas C and D. (c) of FIG. 9 is a graph showing respective reflection characteristics of the antennas E and F.

It is confirmed in comparison of the reflection characteristics of the antennas A and B in (a) of FIG. 9 that omission of some of the short-circuit portions 16 deteriorates the reflection characteristic (increases the reflection coefficient |S11| at 60 GHz) of the antenna 1.

It is confirmed in comparison of the reflection characteristics of the antennas C and D in (b) of FIG. 9 that omission of some of the short-circuit portions 16 deteriorates the reflection characteristic (increases the reflection coefficient |S11| at 60 GHz) of the antenna 1.

It is confirmed in comparison of the reflection characteristics of the antennas E and F in (c) of FIG. 9 that omission of some of the short-circuit portions 16 deteriorates the reflection characteristic (increases the reflection coefficient |S11| at 60 GHz) of the antenna 1.

That is, in order to obtain an excellent reflection characteristic at 60 GHz, it is preferable not to omit any of the short-circuit portions 16, i.e., to provide the short-circuit portions 16 along a whole periphery of the shield 15 except for a portion provided with the cut 15*a*.

FIG. 10 is a view illustrating a reason why the cut 15*a* arranged to have a reverse-taper shape can provide an excellent reflection characteristic. (a) of FIG. 10 is a view schematically illustrating a current distribution formed in the shield 15 whose cut 15*a* has a rectangular shape. (b) of FIG. 10 is a view schematically illustrating a current distribution formed in the shield 15 whose cut 15*a* has a taper shape. (c) of FIG. 10 is a view schematically illustrating a current distribution formed in the shield 15 whose cut 15*a* has a reverse-taper shape.

In a case where the cut 15*a* is arranged to have a rectangular or taper shape, current flows at edges of the cut 15*a*, as indicated by outline arrows in (a) and (b) of FIG. 10. Such current causes re-radiation of an electromagnetic wave and this electromagnetic wave flows backward in the waveguide tube 14. This results in an increase in reflected power. This increase in reflected power is considered to cause deterioration in the reflection characteristic which occurs in a case where the cut 15*a* has a rectangular or taper shape.

(a) of FIG. 11 is a graph showing respective radiation characteristics (z-x plane) at 60 GHz of the antennas A through F. (b) of FIG. 11 is an enlarged graph of (a) of FIG. 11. (c) of FIG. 11 is a graph showing respective radiation characteristics (y-z plane) at 60 GHz of the antennas A through F. (d) of FIG. 11 is an enlarged graph of (c) of FIG. 11.

It is confirmed in comparison of maximum gains of the antennas A thorough F in FIG. 11 that the maximum gain of the antenna F is largest. That is, the antenna F capable of providing the best reflection characteristic at 60 GHz is also an antenna making it possible to obtain the largest maximum gain at 60 GHz.

One reason why such a result is obtained is that arranging the cut 15*a* in a reverse-taper shape results in synthesis of an electromagnetic wave radiated from the stubs 12*b*1 through 12*b*11 with an electromagnetic wave radiated from the waveguide tube 14.

[Influence of Taper Ratio of Cut on Characteristics]

With reference to FIGS. 12 through 16, the following discusses an influence of a taper ratio of the cut 15*a* on the reflection characteristics and the radiation characteristics of the antenna 1 in the present Example.

Here, the following discusses a group of antennas obtained by changing a ratio x1/x0 in the antenna 1 in the present Example and compares characteristics of the antennas. As illustrated in FIG. 12, x0 [mm] is a width of the cut 15*a* at the open end of the cut 15*a*, and x1 [mm] is a width of the cut 15*a* at the inward end of the cut 15*a*. Since a depth of the cut 15*a* is 1.7 mm, the taper ratio is given by (x1−x0)/1.7.

FIG. 13 is a graph showing reflection characteristics of the antenna 1 in cases where x0 is fixed to 0.84 and the ratio x1/x0 is 1.07, 1.31, 1.55, 1.79, 2.02, and 2.26.

(a) of FIG. 14 is a graph showing how the reflection coefficient |S11| at 60 GHz depends on the ratio x1/x0. (b) and (c) of FIG. 14 are enlarged graphs of (a) of FIG. 14.

It is clear from FIG. 14 that it is preferable to set the ratio x1/x0 in a range of 1.0 or more and 2.0 or less. This is because the ratio x1/x0 in this range makes it possible to suppress the reflection coefficient |S11| at 60 GHz to generally −10 dB or less. It is also clear from FIG. 14 that it is more preferable to set the ratio x1/x0 in a range of 1.35 or more and 1.45 or less or in a range of 1.87 or more and 1.93 or less. This is because the ratio x1/x0 in this range makes it possible to suppress the reflection coefficient |S11| at 60 GHz to generally −15 dB or less.

FIG. 15 is a graph showing radiation characteristics (y-z plane) at 60 GHz of the antenna 1 in cases where x0 is fixed to 0.84 and the ratio x1/x0 is set to 1.05, 1.18, 1.33, 1.54, and 1.82.

FIG. 16 is a graph showing how the maximum gain and the sidelobe level depend on the ratio x1/x0.

It is clear from FIG. 16 that it is preferable to set the ratio x1/x0 in a range of 2.5 or less. This is because the ratio x1/x0 in this range allows the maximum gain to be generally 10 dBi or more. Furthermore, it is clear from FIG. 16 that it is more preferable to set the ratio x1/x0 in a range of 1.5 or less. This is because the ratio x1/x0 in this range allows the sidelobe level to be generally 10 dB or more.

[Influence of Insertion Length of Power Feed Line on Characteristics]

With reference to FIGS. 17 and 18, the following discusses an influence of an insertion length Ly of the power feed line 12*a* on the reflection characteristics and the radiation characteristics. The insertion length Ly of the power feed line 12*a* is a length from the open end of the cut 15*a* to an end of the power feed line 12*a*, as illustrated in FIG. 17.

(a) of FIG. 18 is a graph showing reflection characteristics of the antenna 1 in a case where a normalized insertion length Ly/λ is changed from 0.2 to 0.4 with an increment of 0.02 each time. The normalized insertion length Ly/λ is obtained by normalizing the insertion length Ly/λ with a resonant wavelength λ (5 mm in the present Example) of a microstrip antenna. (b) of FIG. 18 is a graph showing dependency of the reflection coefficient |S11| on the normalized insertion length Ly/λ at 60 GHz.

It is clear from FIG. 18 that in a case where the normalized insertion length Ly/λ is 0.28 or more and 0.31 or less, the reflection coefficient |S11| is −10 dB or less. It is also clear from FIG. 18 that in a case where the normalized insertion length Ly/λ is 0.3, i.e., the insertion length Ly is 1.5 mm, the reflection coefficient |S11| at 60 GHz is the smallest.

[Influence of Layout of Short-Circuit Portions on Characteristics]

With reference to FIGS. 19 through 21, the following discusses an influence of a layout of the short-circuit portions 16 on the reflection characteristics and the radiation characteristics of the antenna 1 in the present Example.

The following compares characteristics obtained in cases where the short-circuit portions 16 are arranged in layouts as below in the antenna 1 in the present Example.

Layout A1: a layout omitting the short-circuit portions 16 along both short sides of the shield 15 as illustrated in (a) of FIG. 19, that is, a layout where the short-circuit portions 16 are provided only along both long sides of the shield 15.

Layout A2: a layout omitting the short-circuit portions 16 along a long side of the shield 15 which long side is opposite to the other long side of the shield 15 which other long side has a cut, as illustrated in (b) of FIG. 19, that is, a layout where the short-circuit portions 16 are provided only along both short sides of the shield 15 and the other long side of the shield 15 which other long side has the cut.

Layout A3: a layout omitting the short-circuit portions 16 along both short sides of the shield 15 and the long side opposite to the other long side of the shield 15 which other long side has a cut, as illustrated in (c) of FIG. 19, that is, a layout where the short-circuit portions 16 are provided only along the other long side of the shield 15 which other long side has the cut.

Layout A4: a layout omitting the short-circuit portions 16 along both short sides and both long sides of the shield 15, as illustrated in (d) of FIG. 19, that is, a layout where no short-circuit portion 16 is provided.

Layout A5: a layout omitting the short-circuit portions 16 along the other long side of the shield 15 which other long side has a cut, as illustrated in (e) of FIG. 19, that is, a layout where the short-circuit portions 16 are provided along both short sides of the shield 15 and only the long side opposite to the other long side of the shield 15 which other long side has the cut.

Layout A6: a layout where the short-circuit portions are provided as in the antenna 1 in the present Example, that is, a layout where the short-circuit portions 16 are provided along a whole periphery of the shield 15 except for a portion provided with the cut 15*a*.

FIG. 20 is a graph showing the reflection characteristics of the antenna 1 in cases where the short-circuit portions 16 are provided in the layouts A1 through A6.

It is confirmed from FIG. 20 that omission of some or all of the short-circuit portions 16 causes a shift of a frequency at which the reflection coefficient |S11| is minimum. It is also confirmed that the reflection coefficient |S11| is minimum at 60 GHz which is a designed resonant frequency of a microstrip antenna, in a case where the short-circuit portions 16 are arranged in the layout A6, i.e., in a case where the short-circuit portions 16 are provided along a whole periphery of the shield 15 except for a portion provided with the cut 15*a*.

(a) of FIG. 21 is a graph showing radiation characteristics (y-z plane) at 60 GHz of the antenna 1 in cases where the short-circuit portions 16 are arranged in the layouts A1 through A6. (b) of FIG. 21 is a graph showing radiation characteristics (z-x plane) at 60 GHz of the antenna 1 in cases where the short-circuit portions 16 are provided in the layouts A1 through A6.

It is confirmed from FIG. 21 that in a case where the short-circuit portions 16 are provided in the layout A4, i.e., in a case where no short-circuit portion 16 is provided, a sufficient gain cannot be obtained in a zenith direction. It is also confirmed from FIG. 21 that in a case where the short-circuit portions 16 are provided in the layout A5 or A6, i.e., in a case where the short-circuit portions 16 are provided at least along both short sides of the shield 15 and the long side which is opposite to the other long side of the shield 15 which other long side has a cut, the maximum gain exceeds 10 dB.

[Influence of Omission of Slits in Stubs on Characteristics]

With reference to FIGS. 22 through 30, the following discusses an influence of omission of slits 12*c* in the stubs 12*b*1 through 12*b*10 on the reflection characteristics and the radiation characteristics.

Here, an antenna obtained by omitting the slits 12*c* from the antenna 1 in the present Example is used as a Comparative Example. (a) of FIG. 22 is a plan view of the antenna 1 in the present Example. (b) of FIG. 22 is a plan view of the antenna in the Comparative Example.

(a) of FIG. 23 is a graph showing respective reflection characteristics of the antenna 1 in the present Example and the antenna in the Comparative Example. (b) of FIG. 23 is a graph showing respective radiation characteristics (y-z plane) of the antenna 1 in the present Example and the antenna in the Comparative Example.

It is confirmed from FIG. 23 that formation of the slits 12*c* decreases the reflection coefficient |S11| at 60 GHz and concurrently increases the maximum gain at 60 GHz. That is, it is confirmed that formation of the slits 12*c* improves the reflection characteristic and the radiation characteristic.

In a case where the slits 12*c* are omitted, current flows at the roots of the stubs 12*b* as indicated by solid black arrows in (b) of FIG. 22. It is considered that omission of the slits 12*c* deteriorates the reflection characteristic because the current flowing at the roots of the stubs 12*b* has a component flowing toward the input end of the power feed line 12*a*. It is also considered that omission of the slits 12*c* deteriorates the radiation characteristic because an electromagnetic wave produced by the current flowing at the roots of the stubs 12*b* destructively interferes with an electromagnetic wave produced by current flowing in the stubs 12*b*. In a case where the slits 12*c* are provided, current flows in opposite directions along respective sides facing each other via the slit 12*c*, as indicated by outline arrows in (a) of FIG. 22. Consequently, the reflection characteristic and the radiation characteristic are not deteriorated, unlike those in the case where the slits 12*c* are omitted.

[Influence of Shape of Slits in Stubs on Characteristics]

With reference to FIGS. 24 through 28, the following discusses an influence of the shape of the slits 12*c* in the stubs 12*b*1 through 12*b*10 on the reflection characteristics and the radiation characteristics.

Here, the following discusses a group of antennas obtained by changing a width Wst and a depth Lst of the slit 12*c* of the antenna 1 in the present Example, and compares characteristics of the antennas with each other. As for definitions of the width Wst and the depth Lst of the slits 12*c*, see FIG. 24. Hereinafter, instead of the width Wst itself of the slits 12*c*, a normalized width Wnorm (=Wst/Wmsl, i.e., obtained by normalizing the width Wst with a width Wmsl of the stubs 12*b*) is used. Furthermore, instead of the depth Lst itself of the slits 12*c*, a normalized depth Lnorm (=Lst/Wmsl, i.e., obtained by normalizing the depth Lst with the width Wmsl of the stubs 12*b*) is used.

FIG. 25 is a graph showing how the reflection coefficient |S11|, the maximum gain, and the sidelobe level at 60 GHz of the antenna 1 in the present Example depend on Wnorm and Lnorm in a case where the slits 12*c* has a square shape (Wnorm=Lnorm).

It is confirmed from FIG. 25 that in a case where Wnorm and Lnorm are each 0.2 or more and 0.5 or more, the reflection coefficient |S11| at 60 GHz is −10 dB or less, the maximum gain at 60 GHz is 10 dBi or more, and the sidelobe level at 60 GHz is 10 dB or more.

FIG. 26 is a graph showing how the reflection coefficient |S11| at 60 GHz of the antenna 1 in the present Example depends on Wnorm and Lnorm.

It is confirmed from FIG. 26 that in a case where Wnorm and Lnorm are each 0.23 or more and 0.45 or more, the reflection coefficient |S11| at 60 GHz is −10 dB or less.

FIG. 27 is a graph showing how the maximum gain at 60 GHz of the antenna 1 in the present Example depends on Wnorm and Lnorm.

It is confirmed from FIG. 27 that in a case where Wnorm and Lnorm are each 0.23 or more and 0.45 or more, the maximum gain at 60 GHz is 10 dBi or more.

FIG. 28 is a graph showing how the sidelobe level at 60 GHz of the antenna 1 in the present Example depends on Wnorm and Lnorm.

It is confirmed from FIG. 28 that in a case where Wnorm and Lnorm are each 0.23 or more and 0.45 or more, the sidelobe level at 60 GHz is 10 dB or more.

Lastly, with reference to FIG. 30, the following discusses the characteristics of the antenna 1 in the present Example in a case where the roots of the stubs 12*b* are provided, respectively, with slits 12*d* (see FIG. 29) each of which extends from one side of each stub in a direction from the input-end side of the power feed line 12*a* toward the output-end side of the power feed line 12*a*.

FIG. 30 is a graph showing how the reflection coefficient |S11|, the maximum gain, and the sidelobe level at 60 GHz of the antenna 1 in the present Example depend on Wnorm and Lnorm in a case where both of the slits 12*c* and the slits 12*d* have a square shape (Wnorm=Lnorm).

It is confirmed from FIG. 30 that in a case where Wnorm and Lnorm are each 0.3 or less, the reflection coefficient |S11| at 60 GHz is −10 dB or less, the maximum gain at 60 GHz is 10 dBi or more, and the sidelobe level at 60 GHz is generally 10 dB or more.

[Summary of Embodiment]

As described above, the antenna in accordance with the present embodiment is an antenna, including: a dielectric substrate; an antenna conductor on a front surface of the dielectric substrate, the antenna conductor being a comb-line antenna conductor including a power feed line and stubs; a ground conductor on a back surface of the dielectric substrate, the ground conductor including an opening in a region facing an input end of the power feed line; a waveguide tube joined to the back surface of the dielectric substrate, the waveguide tube having (i) a tube axis orthogonal to the back surface of the dielectric substrate and (ii) a tube wall whose edge surface surrounds the opening; a shield on the front surface of the dielectric substrate, the shield having a cut into which the input end of the power feed line is inserted; and short-circuit portions each short-circuiting the ground conductor and the shield, the short-circuit portions each penetrating the dielectric substrate, the short-circuit portions being provided along a whole periphery of the shield except for a portion provided with the cut, the cut having a reverse-taper shape whose width becomes greater from an open end of the cut to an inward end of the cut.

With the arrangement, it is possible to provide an antenna having better reflection characteristics and radiation characteristics than those of a conventional antenna.

The antenna in accordance with the present embodiment is preferably arranged such that a ratio x1/x0 is 2.5 or less, where x0 is a width of the cut at the open end of the cut, and x1 is a width of the cut at the inward end of the cut.

With the arrangement, the antenna can have the maximum gain of generally 10 dBi or more at a resonant frequency of a microstrip antenna constituted by the dielectric substrate, the antenna conductor, and the ground conductor.

The antenna in accordance with the present embodiment is preferably arranged such that the ratio x1/x0 is 1.0 or more and 2.0 or less.

With the arrangement, the antenna can have the maximum gain of generally 10 dBi or more and a reflection coefficient of generally −10 dBi or less at the resonant frequency of the microstrip antenna.

The antenna in accordance with the present embodiment is preferably arranged such that the ratio x1/x0 is 1.0 or more and 1.5 or less.

With the arrangement, the antenna can have the maximum gain of generally 10 dBi or more, the reflection coefficient of generally −10 dB or less, and a sidelobe level of generally 10 dB or more at the resonant frequency of the microstrip antenna.

The antenna in accordance with the present embodiment is preferably arranged such that the ratio x1/x0 is 1.35 or more and 1.45 or less.

With the arrangement, the antenna can have the maximum gain of generally 10 dBi or more, the reflection coefficient of generally −15 dB or less, and the sidelobe level of generally 10 dB or more at the resonant frequency of the microstrip antenna.

The antenna in accordance with the present embodiment is preferably arranged such that Ly/λ is 0.28 or more and 0.31 or less, where Ly is a length from the open end of the cut to a front end of the power feed line, and λ is a resonant wavelength of a microstrip antenna constituted by the dielectric substrate, the antenna conductor, and the ground conductor.

With the arrangement, the antenna can suppress the reflection coefficient to −10 dB or less at the resonant frequency of the microstrip antenna.

The antenna in accordance with the present embodiment is preferably arranged such that: each of the stubs extends in a direction orthogonal to the power feed line; and each of the stubs is provided, at a root, with a slit extending in a direction from an output-end side of the power feed line toward an input-end side of the power feed line.

With the arrangement, it is possible to provide an antenna having better reflection characteristics and radiation characteristics than those of a conventional antenna.

The antenna in accordance with the present embodiment is preferably arranged such that Wst/Wmsl and Lst/Wmsl are each 0.23 or more and 0.45 or less, where Wmsl is a width of the each stub, Wst is a width of the slit at the root of the each stub, and Lst is a depth of the slit at the root of the each stub.

With the arrangement, the antenna can have a reflection coefficient |S11| of −10 dB or less, the maximum gain of 10 dBi or more, and the sidelobe level of 10 dB or more at the resonant frequency of the microstrip antenna.

[Additional Matter]

The present invention is not limited to the description of the embodiments (examples) above, but may be altered by a skilled person within the scope of the claims. An embodiment based on a proper combination of technical means disclosed in different embodiments is encompassed in the technical scope of the present invention.

INDUSTRIAL APPLICABILITY

The present invention can be preferably used as an antenna which operates in a millimeter wave band.

REFERENCE SIGNS LIST

1 Antenna
11 Dielectric substrate
12 Antenna conductor
12*a* Power feed line
12*b*1-12*b*11 Stub
12*c* Slit
13 Ground conductor
13*a* Opening
14 Waveguide tube
14*a* Tube wall
14*b* Cavity
15 Shield
15*a* Cut
16 Short-circuit portion

The invention claimed is:

1. An antenna comprising:

a dielectric substrate;

an antenna conductor on a front surface of the dielectric substrate, the antenna conductor being a comb-line antenna conductor including a power feed line and stubs;

a ground conductor on a back surface of the dielectric substrate, the ground conductor including an opening in a region facing an input end of the power feed line;

a waveguide tube joined to the back surface of the dielectric substrate, the waveguide tube having (i) a tube axis orthogonal to the back surface of the dielectric substrate and (ii) a tube wall whose edge surface surrounds the opening;

a shield on the front surface of the dielectric substrate, the shield having a cut into which the input end of the power feed line is inserted; and short-circuit portions each short-circuiting the ground conductor and the shield, the short-circuit portions each penetrating the dielectric substrate, the short-circuit portions being provided along a whole periphery of the shield except for a portion provided with the cut, the cut having a reverse-taper shape whose width becomes greater from an open end of the cut to an inward end of the cut, wherein:

each of the stubs extends in a direction orthogonal to the power feed line; and each of the stubs is provided, at a root, with a slit extending in a direction from an output-end side of the power feed line toward an input-end side of the power feed line.

2. The antenna as set forth in claim 1, wherein a ratio x1/x0 is 2.5 or less, where x0 is a width of the cut at the open end of the cut, and x1 is a width of the cut at the inward end of the cut.

3. The antenna as set forth in claim 2, wherein the ratio x1/x0 is 1.0 or more and 2.0 or less.

4. The antenna as set forth in claim 3, wherein the ratio x1/x0 is 1.0 or more and 1.5 or less.

5. The antenna as set forth in claim 4, wherein the ratio x1/x0 is 1.35 or more and 1.45 or less.

6. The antenna as set forth in claim 1, wherein Ly/λ is 0.28 or more and 0.31 or less, where Ly is a length from the open end of the cut to a front end of the power feed line, and λ is a resonant wavelength of a microstrip antenna constituted by the dielectric substrate, the antenna conductor, and the ground conductor.

7. The antenna as set forth in claim 1, wherein Wst/Wmsl and Lst/Wmsl are each 0.23 or more and 0.45 or less, where Wmsl is a width of the each stub, Wst is a width of the slit at the root of the each stub, and Lst is a depth of the slit at the root of the each stub.

* * * * *